US009899738B2

(12) United States Patent
Shimura et al.

(10) Patent No.: US 9,899,738 B2
(45) Date of Patent: Feb. 20, 2018

(54) ANTENNA

(71) Applicant: CANON KABUSHIKI KAISHA, Tokyo (JP)

(72) Inventors: Hajime Shimura, Tokyo (JP); Jun Morita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 707 days.

(21) Appl. No.: 14/454,587

(22) Filed: Aug. 7, 2014

(65) Prior Publication Data

US 2015/0054706 A1 Feb. 26, 2015

(30) Foreign Application Priority Data

Aug. 20, 2013 (JP) ..... 2013-170820
Jul. 31, 2014 (JP) ..... 2014-156277

(51) Int. Cl.

| | |
|---|---|
| ***H01Q 11/00*** | (2006.01) |
| ***H01Q 9/04*** | (2006.01) |
| ***H01Q 1/24*** | (2006.01) |
| ***H01Q 9/40*** | (2006.01) |
| ***H01Q 9/42*** | (2006.01) |
| ***H01Q 5/371*** | (2015.01) |
| ***H01Q 1/50*** | (2006.01) |
| ***H01Q 5/30*** | (2015.01) |

(52) U.S. Cl.

CPC ..... *H01Q 9/0407* (2013.01); *H01Q 1/243* (2013.01); *H01Q 1/50* (2013.01); *H01Q 5/30* (2015.01); *H01Q 5/371* (2015.01); *H01Q 9/40* (2013.01); *H01Q 9/42* (2013.01)

(58) Field of Classification Search

CPC ..... H01Q 9/24; H01Q 1/243
USPC ..... 343/843
See application file for complete search history.

(56) References Cited

U.S. PATENT DOCUMENTS

| | | | |
|---|---|---|---|
| 6,040,803 | A | 3/2000 | Spall |
| 6,456,243 | B1 | 9/2002 | Poilasne et al. |
| 6,646,607 | B2 | 11/2003 | Usui et al. |

(Continued)

FOREIGN PATENT DOCUMENTS

| | | | |
|---|---|---|---|
| CN | 101510630 | A | 8/2009 |
| CN | 102570003 | A | 7/2012 |

(Continued)

OTHER PUBLICATIONS

European Office Action dated Jan. 19, 2015 for counterpart European Patent Appln No. 14181468.1.
Chinese Office Action dated Sep. 2, 2016 in Chinese Application No. 201410410737.0.

(Continued)

*Primary Examiner* — Graham Smith
(74) *Attorney, Agent, or Firm* — Fitzpatrick, Cella, Harper & Scinto

(57) ABSTRACT

An antenna that comprises a feeding point, a first conductor and a second conductor is provided. The first conductor is connected to the feeding point, includes, as an open end, an end which is not connected to the feeding point, and has a linear shape. The second conductor is formed to branch from the first conductor, includes, as an open end, an end on an opposite side of a point branching from the first conductor, and has a linear shape. At least part of the first conductor and at least part of the second conductor are formed on different planes and include coupling portions electromagnetically coupled to each other.

12 Claims, 18 Drawing Sheets

(56) References Cited

U.S. PATENT DOCUMENTS

| | | | | |
|---|---|---|---|---|
| 7,532,718 | B2 * | 5/2009 | Cohen | H04B 1/385 343/718 |
| 8,175,067 | B2 | 5/2012 | Shimura | |
| 8,547,947 | B2 | 10/2013 | Shimura | |
| 8,699,431 | B2 | 4/2014 | Shimura | |
| 8,804,683 | B2 | 8/2014 | Shimura | |
| 2004/0246180 | A1 | 12/2004 | Okado | |
| 2007/0040748 | A1 | 2/2007 | Mei | |
| 2010/0214174 | A1 | 8/2010 | Guan et al. | |
| 2011/0148724 | A1 * | 6/2011 | Ogawa | H01Q 1/243 343/767 |
| 2012/0007782 | A1 | 1/2012 | Nishio et al. | |
| 2012/0092220 | A1 | 4/2012 | Tani et al. | |
| 2012/0306703 | A1 | 12/2012 | Komaki et al. | |
| 2014/0043198 | A1 | 2/2014 | Shimura | |
| 2014/0267813 | A1 | 9/2014 | Shimura | |

FOREIGN PATENT DOCUMENTS

| | | | |
|---|---|---|---|
| CN | 202957346 | U | 5/2013 |
| JP | 2002-504770 | A | 2/2002 |
| JP | 2003-008325 | A | 1/2003 |
| JP | 2007-036338 | A | 2/2007 |
| JP | 2012-085215 | A | 4/2012 |
| WO | 99/43043 | A1 | 8/1999 |

OTHER PUBLICATIONS

Chinese Office Action dated Aug. 23, 2017 in Chinese Patent Application No. 201410410737.0.

* cited by examiner

ANTENNA

BACKGROUND OF THE INVENTION

Field of the Invention

The present invention relates to a technique for antenna configuration.

Description of the Related Art

Recently, wireless communication functions are mounted in various types of electronic devices. Many electronic devices are required to be downsized. Along with this requirement, antennas for wireless communication are required to be implemented in small spaces of these electronic devices. Under this circumstance, Japanese Patent Laid-Open No. 2012-085215 discloses an antenna structure having an antenna formed by using only a substrate and a conductive pattern without any member largely protruding from a plane of the substrate. In addition, Japanese Patent Laid-Open No. 2003-008325 discloses an antenna configured to have first and second antennas respectively arranged in occupation areas for the first and second antennas on the respective surfaces of an insulating substrate. According to Japanese Patent Laid-Open No. 2003-008325, the downsizing of an antenna apparatus including a plurality of antennas is achieved by making the occupation areas for the first and second antennas overlap each other at least partially when viewed from a direction at a right angle to the surface of the insulating substrate. Japanese Patent Laid-Open No. 2002-504770 discloses a compact planar diversity antenna including two radiation elements which are fixed to the two surfaces of a dielectric substrate and coupled without power feeding so as to cooperatively resonate in two adjacent frequency bands.

Along with mounting and the like of a MIMO communication function using a plurality of antennas, there are increasing demands for the downsizing of antennas. On the other hand, the downsizing of an antenna sometimes leads to a failure to ensure satisfactory antenna performance. That is, conventional antennas have difficulty in achieving a satisfactory reduction in antenna size while ensuring satisfactory antenna performance.

The present invention has been made in consideration of the above problems, and provides a technique of facilitating the downsizing of an antenna while ensuring antenna performance.

SUMMARY OF THE INVENTION

According to one aspect of the present invention, there is provided an antenna comprising: a feeding point; a first conductor which is connected to the feeding point, includes, as an open end, an end which is not connected to the feeding point, and has a linear shape; and a second conductor which is formed to branch from the first conductor, includes, as an open end, an end on an opposite side of a point branching from the first conductor, and has a linear shape, wherein at least part of the first conductor and at least part of the second conductor are formed on different planes and include coupling portions electromagnetically coupled to each other.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

This embodiment considers an antenna used for a wireless communication function complying with a wireless LAN standard (for example, IEEE802.11b/g/n). IEEE802.11b/g/n requires an antenna which operates in the 2.4-GHz band. A single band antenna which operates in the 2.4-GHz band will therefore be described.

Figure 1A:
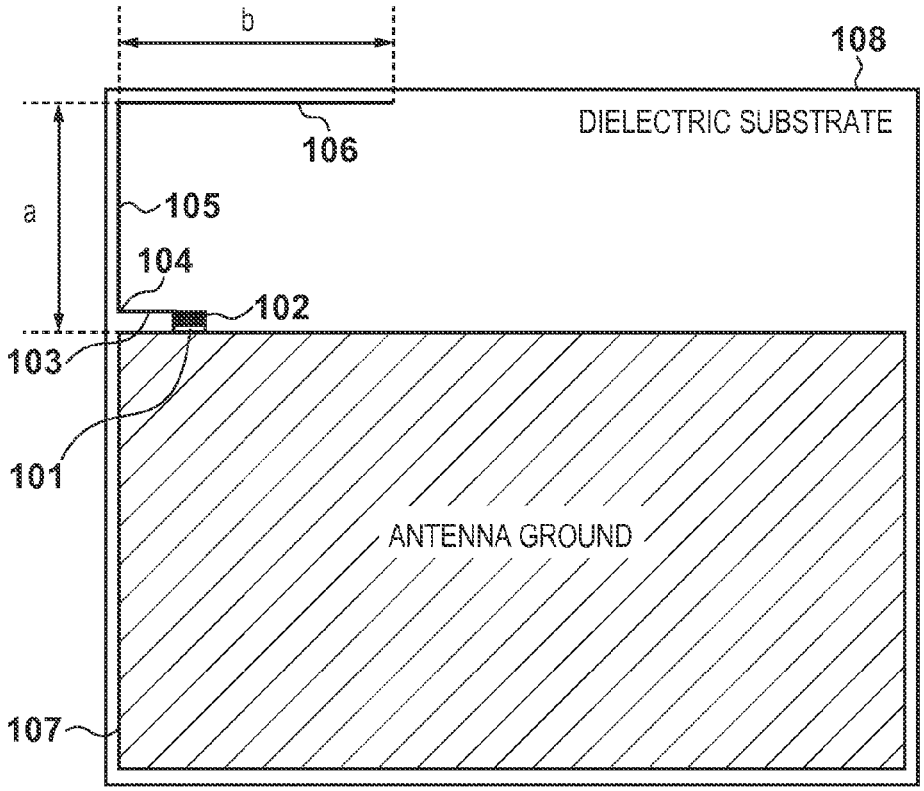
FIG. 1A is a front view showing the arrangement of a conventional single band antenna.
Figure 1B:
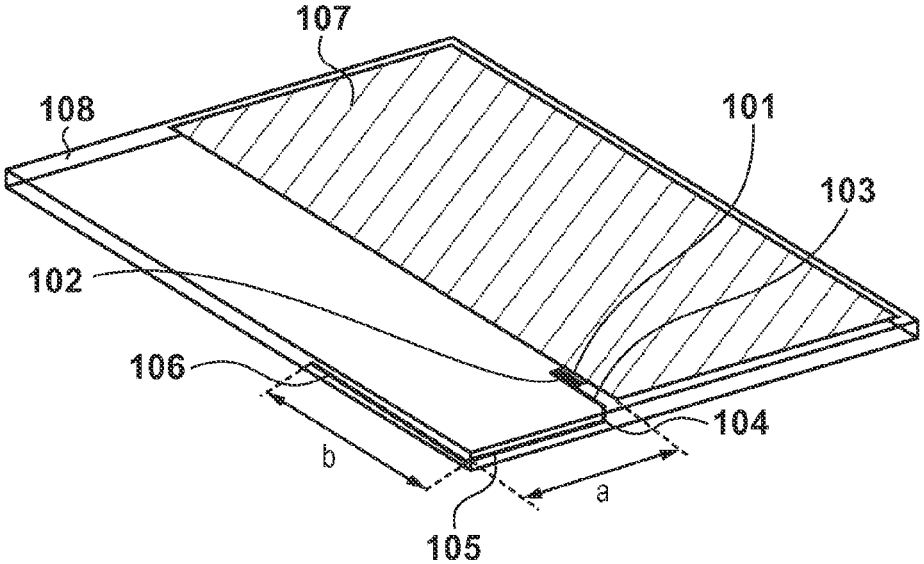
FIG. 1B is a perspective view of the antenna.

FIGS. 1A and 1B are a front view and a perspective view, respectively, showing an example of the arrangement of a conventional single band antenna. Referring to FIGS. 1A and 1B, a conductor is indicated by a black portion. In addition, an antenna ground 107 formed from a conductor is indicated by a hatched portion. In practice, various types of components and circuits for implementing a wireless function are mounted on the antenna ground 107. This embodiment gives no consideration to these components and circuits. Note that in practice, a conductor is formed on a plane of a substrate in the form of a pattern. Close observation of this conductor will therefore reveal that it has a thin plate-like shape. In this specification and the scope of the claims, such shapes are expressed as "linear shapes".

As shown in FIGS. 1A and 1B, a conventional single band antenna includes a feeding point 101, conductors 102 to 106, the antenna ground 107, and a dielectric substrate (FR4 substrate) 108. The dielectric substrate (FR4 substrate) has, as surfaces on which an antenna is formed, the first plane corresponding to the front surface and the second plane corresponding to the back surface. Note that the first and second planes are planes which face each other and are parallel to each other.

The antenna in FIGS. 1A and 1B is configured such that the feeding point 101, the conductor 102, and the conductor 103 are formed on the first plane (front surface) of the dielectric substrate, and the conductor 105 and the conductor 106 are formed on the second plane (back surface) of the dielectric substrate. In this case, one end of the conductor 102 is connected to one end of the conductor 103. Likewise, one end of the conductor 105 is connected to one end of the conductor 106. In addition, the conductor 103 formed on the first plane and the conductor 105 formed on the second plane each have, for example, a cylindrical shape, and are connected to each other via a through hole via (conductor 104). That is, the conductors 102 to 106 form one linear antenna extending astride the front and back surfaces of the dielectric substrate 108. Note that the feeding point 101 is formed as a feeding pin on the conductor 102. Power is supplied to the antenna formed by the conductors 102 to 106. The power excited by the antenna is output outside the antenna. An end of the conductor 106 which is not connected to the conductor 105 is an open end.

The dielectric substrate (FR4 substrate) 108 has a relative dielectric constant of, for example, 4.4. A portion, on the dielectric substrate (FR4 substrate) 108, on which the antenna ground 107 is not formed is an antenna region. The thickness of the substrate including the dielectric substrate and the conductors is, for example, 0.896 mm, and the size of the substrate is, for example, 30 mm×35 mm. In addition, the conductors 103, 105, and 106 each have a line width of, for example, 0.2 mm. The cylindrical shape of the conductor 104 which connects the conductors 103 and 105 to each other has a radius of, for example, 0.1 mm. Furthermore, for example, lengths a and b of the antenna in the longitudinal and lateral directions are respectively 10 mm and 12 mm. That is, the antenna size is, for example, 10 mm×12 mm.

Figure 2A:
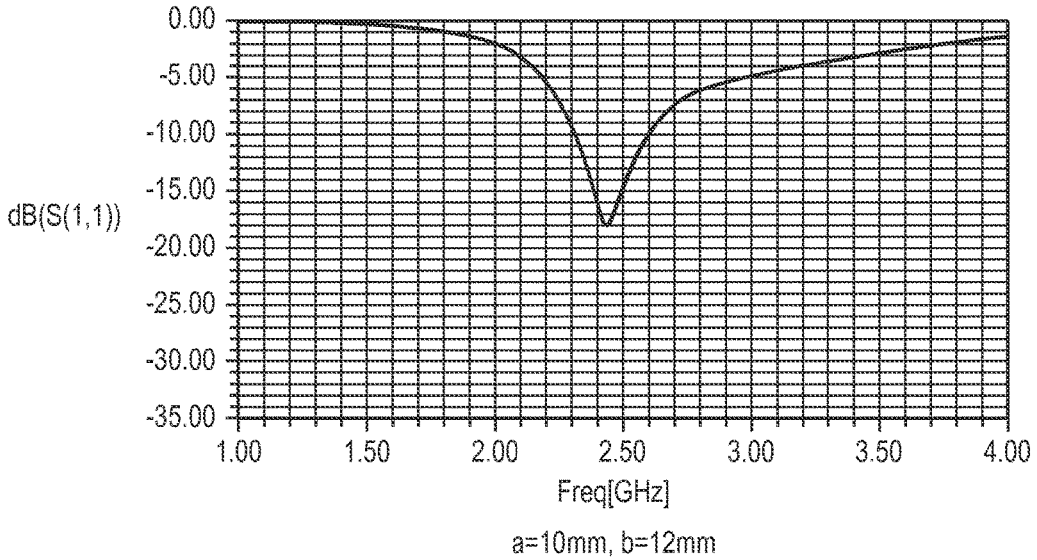
FIGS. 2A and 2B are graphs showing the simulation results of the reflection characteristic (S11) of the signal band antenna in FIGS. 1A and 1B.

FIG. 2A is a graph showing the simulation result of the reflection characteristic (S11) of the single band antenna shown in FIGS. 1A and 1B when the lengths of the antenna in the longitudinal and lateral directions are 10 mm and 12 mm, respectively. As is obvious from FIG. 2A, the antenna obtains a satisfactory reflection characteristic in the 2.4-GHz band used in IEEE802.11b/g/n. When the reflection characteristic is −10 dB or less, the bandwidth is about 300 MHz. That is, it is obvious that with this arrangement, the antenna shown in FIGS. 1A and 1B can operate as an antenna in this band range.

The antenna has a function of emitting an electromagnetic waves having a specific frequency. If, therefore, an object exists around the antenna, the operating frequency of the antenna can vary or the energy of emitted electromagnetic waves can decrease. For this reason, the antenna used for an electronic device may be made to protrude outside the body of the electronic device incorporating many components and the like instead of being implemented inside the body of the electronic device. For example, a wireless LAN card having a wireless LAN communication function may be inserted into the card slot of a notebook PC. In this case, when the antenna implemented in the wireless LAN card is incorporated in the notebook PC, this structure will hinder the emission of electromagnetic waves emitted from the antenna. For this reason, the antenna implementation portion of the wireless LAN card protrudes outside the notebook PC. However, the user may be caught on such a protruding portion of the antenna during, for example, an operation. For this reason, the antenna implemented in the wireless LAN card is required to be thin, that is, have an area with its short side being as short as possible compared with its long side, and to minimize the antenna protruding portion protruding outside the notebook PC.

Figure 2B:
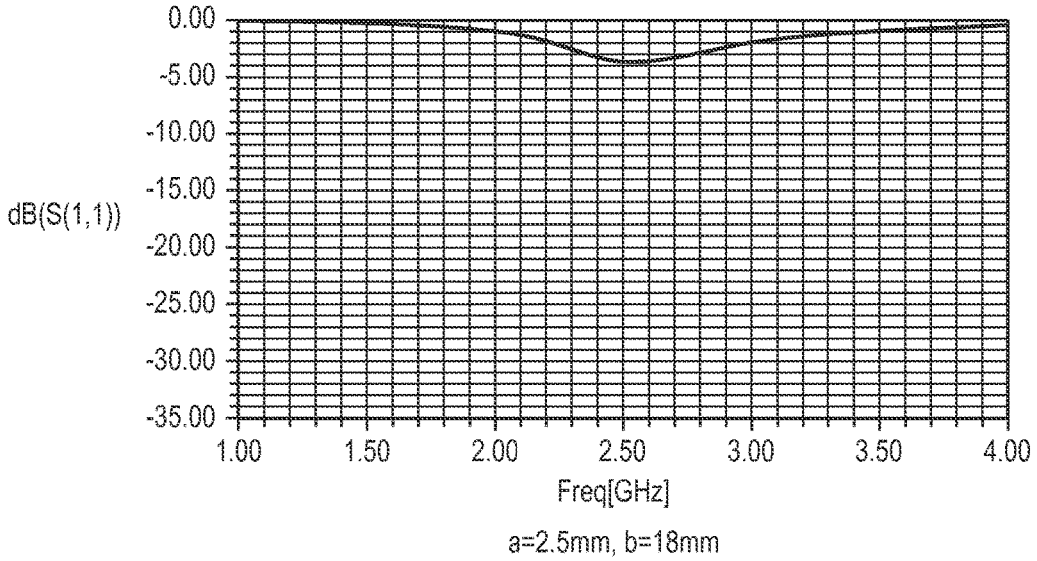

Consider, therefore, a case in which the length a is decreased to 2.5 mm and the length b is increased to 18 mm while the sum of the lengths of the conductors 102 to 106 as the antenna length is kept almost unchanged in FIGS. 1A and 1B. In this case, the antenna size becomes 2.5 mm×18 mm. FIG. 2B shows the simulation result of the reflection characteristic (S11). As shown in FIG. 2B, in this case, it is obvious that the reflection characteristic does not meet the requirement of −6 dB in the 2.4-GHz band, and hence is not satisfactory in terms of operation as an antenna. That is, it was found that in the antenna arrangement shown in FIGS. 1A and 1B, decreasing the length a would degrade the antenna characteristic.

Figure 3A:
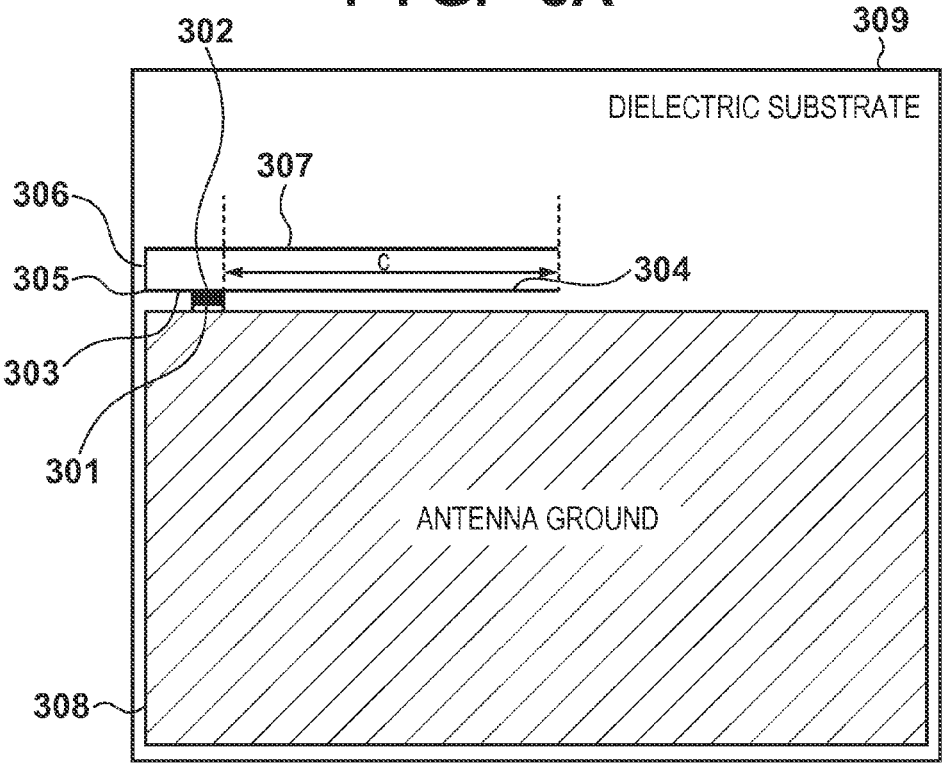
FIG. 3A is a front view showing the arrangement of an antenna having a branch portion.
Figure 3B:
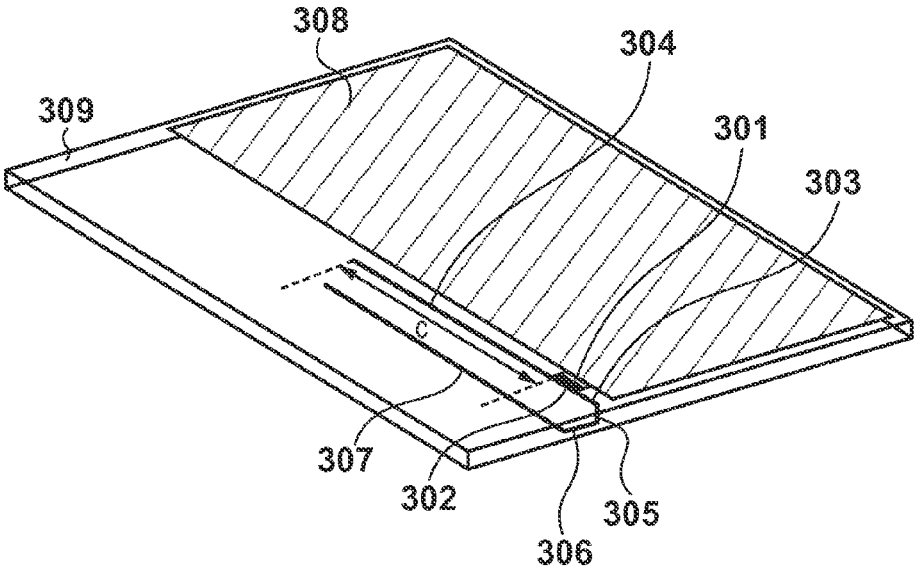
FIG. 3B is a perspective view of the antenna.

In contrast to this, an antenna according to this embodiment has an arrangement which allows the antenna to operate as an antenna even with a decrease in the length of the antenna in the longitudinal direction. This antenna arrangement will be described in detail below. FIGS. 3A and 3B are a front view and a perspective view, respectively, showing an example of the arrangement of a single band antenna according to the embodiment. The antenna shown in FIGS. 3A and 3B has a structure in which another conductor 304 is branched from the conductor 102 of the antenna arrangement shown in FIGS. 1A and 1B.

The single band antenna according to this embodiment includes a feeding point 301, conductors 302 to 307, an antenna ground 308, and a dielectric substrate (FR4 substrate) 309. The first conductor constituted by the feeding point 301, the conductors 302 and 303, and the conductors 305 to 307 of the above components has the same antenna structure as that shown in FIGS. 1A and 1B. In this antenna, the conductor 302 is connected to not only the conductor 303 but also the conductor 304, thus forming a branched structure. The second conductor (branch portion) formed from the conductor 304 is arranged on the first plane (front surface) of the dielectric substrate. Note that an end of the conductor 304 which is not connected to the conductor 303, that is, an end on the opposite side to the branching point, is an open end. Note that the thickness of the substrate of this antenna, which includes the dielectric substrate and the conductors, is the same as that of the antenna structure shown in FIGS. 1A and 1B, for example, 0.896 mm.

Figure 4A:
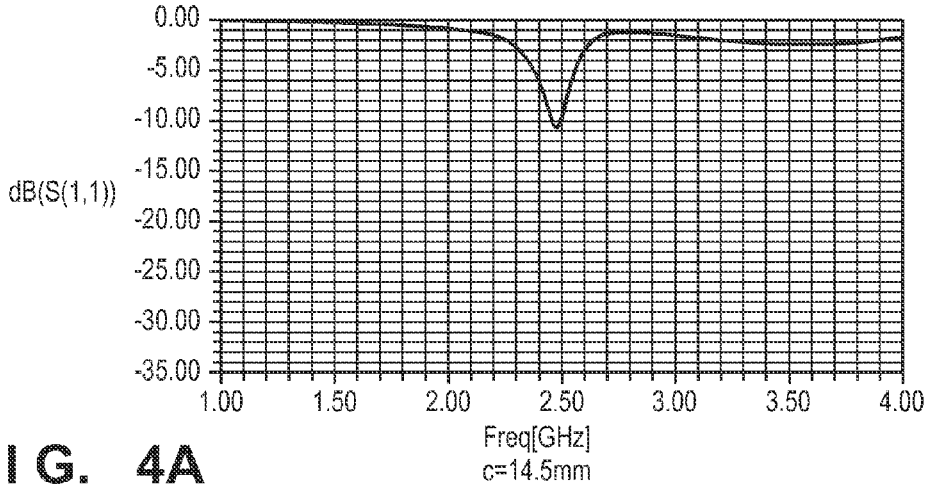
FIGS. 4A to 4C are graphs showing the simulation results of the reflection characteristic (S11) of the antenna in FIGS. 3A and 3B when the length of the branch portion is changed.
Figure 4B:
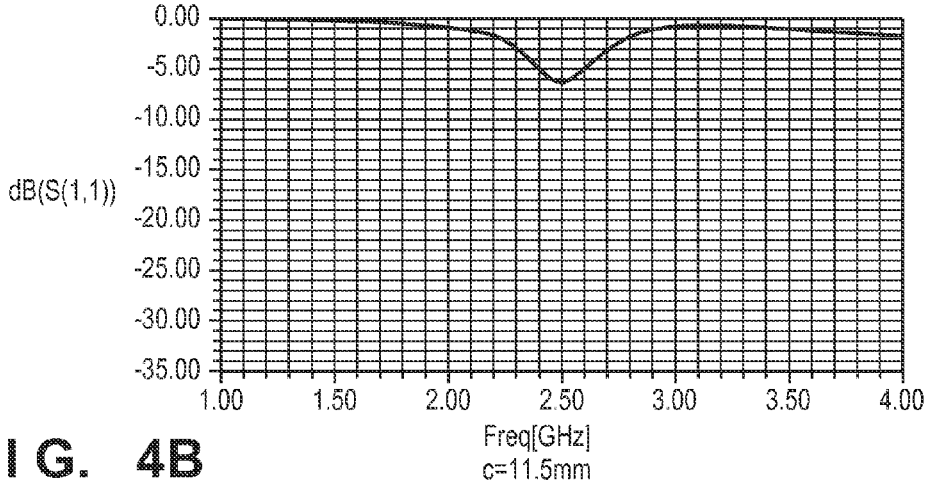
Figure 4C:
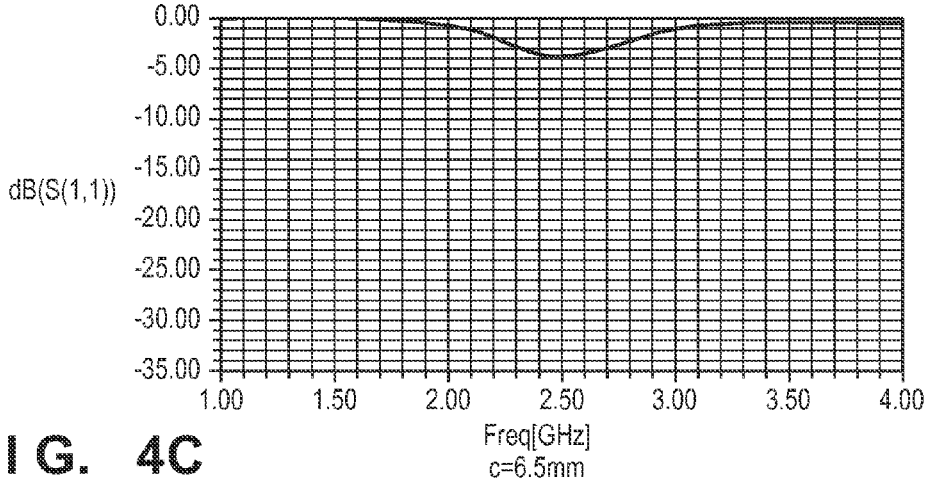

In this antenna, the conductor 304 is electromagnetically coupled to the conductor 307 via the dielectric substrate. With this structure, as in the case shown in FIG. 2B, even when the length of the antenna in the longitudinal direction is decreased, the antenna characteristic is improved. FIGS. 4A to 4C show the simulation results of the reflection characteristic (S11) of the antenna shown in FIGS. 3A and 3B when the length a in the longitudinal direction and the length b in the lateral direction are respectively set to 2.5 mm and 18 mm in accordance with the simulation result shown in FIG. 2B. FIGS. 4A, 4B, and 4C respectively show the simulation results of the reflection characteristic (S11) when a length c of the branch portion is set to 14.5 mm, 11.5 mm, and 6.5 mm.

As is obvious from FIGS. 4A to 4C, as the length c increases, a more satisfactory reflection characteristic can be obtained in the 2.4-GHz band as the operating band in IEEE802.11b/g/n. This can be because as the length c increases, the strength of the electromagnetic coupling between the main body portion of the antenna (the portion constituted by the feeding point 301, the conductors 302 and 303, and the conductors 305 to 307) and the branch portion (the portion formed from the conductor 304) increases. Note that "coupling" in this case indicates electromagnetic coupling including electrostatic coupling (capacitive coupling), magnetic coupling (inductive coupling), and electromagnetic coupling as a mixture of them.

As described above, in the antenna arrangement shown in FIGS. 3A and 3B, a good reflection characteristic can be obtained by adjusting the length of the branch portion electromagnetically coupled to the antenna main body portion, even if the antenna is short in the longitudinal direction. Therefore, the antenna according to this embodiment can facilitate the downsizing of the antenna while ensuring a satisfactory antenna characteristic.

In general, an antenna is required to have a size (length) proportional to the wavelength of corresponding radio waves, and hence increases in length as the operating frequency decreases. For example, it is known that the antenna length of a monopole antenna as a basic antenna is about ¼ of a wavelength in the operating frequency band. Note that "wavelength" in this case is a wavelength in a space in which the antenna is formed. For example, if an antenna is formed in a free space, "wavelength" is a wavelength in the free space. If an antenna is formed in an infinitely large dielectric, "wavelength" is a wavelength in the dielectric. In addition, if an antenna is formed on a dielectric substrate as in this embodiment, "wavelength" is a wavelength calculated by using an effective dielectric constant obtained based on an air layer and a dielectric layer.

On the other hand, according to this embodiment, the resonance frequency can be shifted to a lower frequency by coupling the conductor of the antenna main body portion to the conductor of the branch portion. That is, coupling allows the antenna to have a resonance frequency similar to that of an antenna larger in size than the actual size. This effect can downsize the antenna of this embodiment to, for example, a size smaller than ¼ of the wavelength.

The following will exemplify several arrangement examples of the antenna arrangement shown in FIGS. 3A and 3B, which are configured to downsize the antenna by adjusting the strength of electromagnetic coupling. Note that in the antenna shown in FIGS. 3A and 3B, the branch portion is entirely formed on the first plane and is coupled to the antenna main body portion formed on the second plane. However, the present invention is not limited to this. That is, part of the branch portion may be formed on the second plane and coupled to the antenna main body portion. That is, the same effects as those described above can be obtained as long as at least part of the antenna main body portion and at least part of the branch portion are formed on different planes and have coupling portions which are electromagnetically coupled.

Arrangement Example 1

Figure 5A:
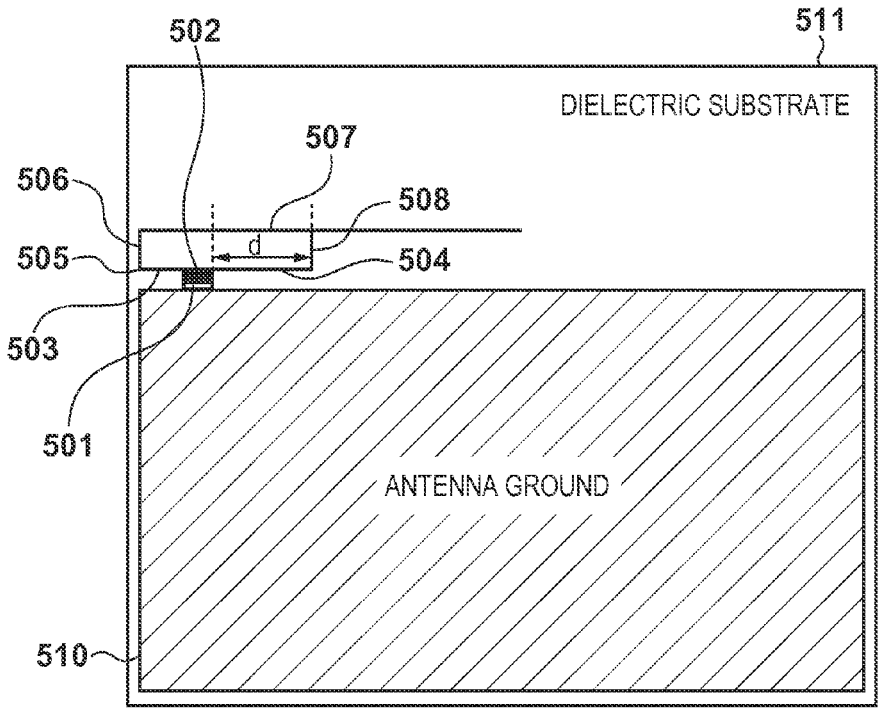
FIG. 5A is a front view showing the arrangement of an antenna according to arrangement example 1.
Figure 5B:
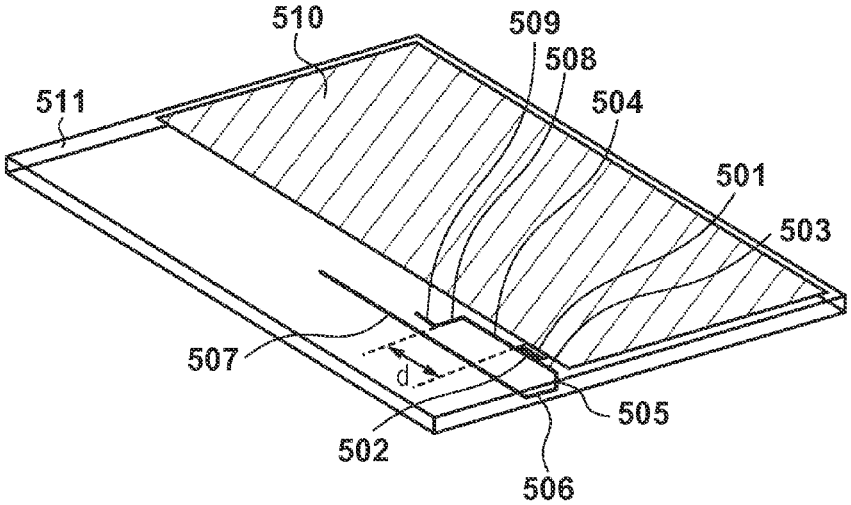
FIG. 5B is a perspective view of the antenna.

In the antenna arrangement shown in FIGS. 3A and 3B, the antenna main body portion and the branch portion can be arranged to further approach each other. FIGS. 5A and 5B are a front view and a perspective view, respectively, showing an arrangement example of the single band antenna, in which the antenna main body and the branch portion are arranged to further approach each other. The antenna shown in FIGS. 5A and 5B has an antenna size of 2.5 mm×18 mm as in the arrangement shown FIGS. 3A and 3B, and includes a dielectric substrate (FR4 substrate) 511 and an antenna ground 510, which are identical to those of the antenna in FIG. 1A and 1B. Likewise, the thickness of the substrate including the dielectric substrate and the conductors is, for example, 0.896 mm.

The antenna shown in FIGS. 5A and 5B differs in the arrangement of the branch portion from the antenna shown in FIGS. 3A and 3B. That is, of conductors 504, 508, and 509 constituting the branch portion, the conductor 509 including an open end is arranged to face a conductor 507 as one of the conductors constituting the antenna main body, when viewed from a direction perpendicular to the surface of the dielectric substrate 511. On the other hand, the arrangement of a feeding point 501, conductors 502 and 503, and conductors 505 to 507, which constitute an antenna main body portion, is the same as that of the antenna main body portion of the antenna shown in FIGS. 3A and 3B. This makes it possible to obtain stronger coupling between the antenna main body portion and the branch portion. Note that the reason why FIG. 5A does not show the conductor 509 is that it has the same line width as that of the conductor 507, and overlaps it. Although in this arrangement example, the conductor 509 is arranged to face the conductor 507 when viewed from a direction perpendicular to the surface of the dielectric substrate 511, the present invention is not limited to this. That is, the conductor 509 may just be arranged within a predetermined distance from the conductor 507 or arranged at a position closer to the conductor 507 than other portions of the branch portion.

The antenna shown in FIGS. 5A and 5B can increase the strength of coupling as compared with the antenna shown in FIGS. 3A and 3B, and can also change the strength of coupling by changing the coupling position between the antenna main body portion and the branch portion. That is, it is possible to change the strength of coupling depending on whether the conductor 509 is arranged at a position close to or far from the open end of the conductor 507 of the antenna main body portion.

Figure 6A:
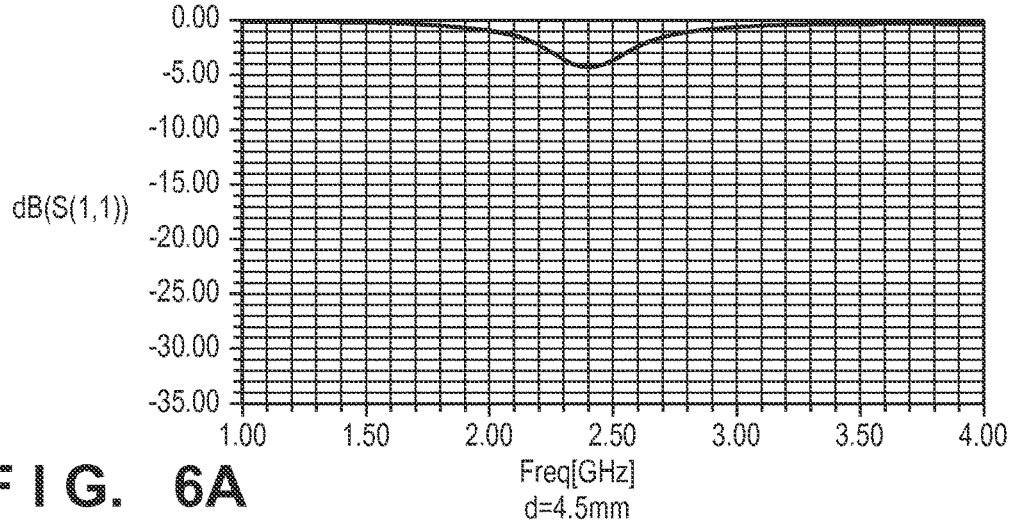
FIGS. 6A to 6C are graphs showing the simulation results of the reflection characteristic (S11) of the antenna in FIGS. 5A and 5B when the position of an open end of a branch portion is changed.
Figure 6B:
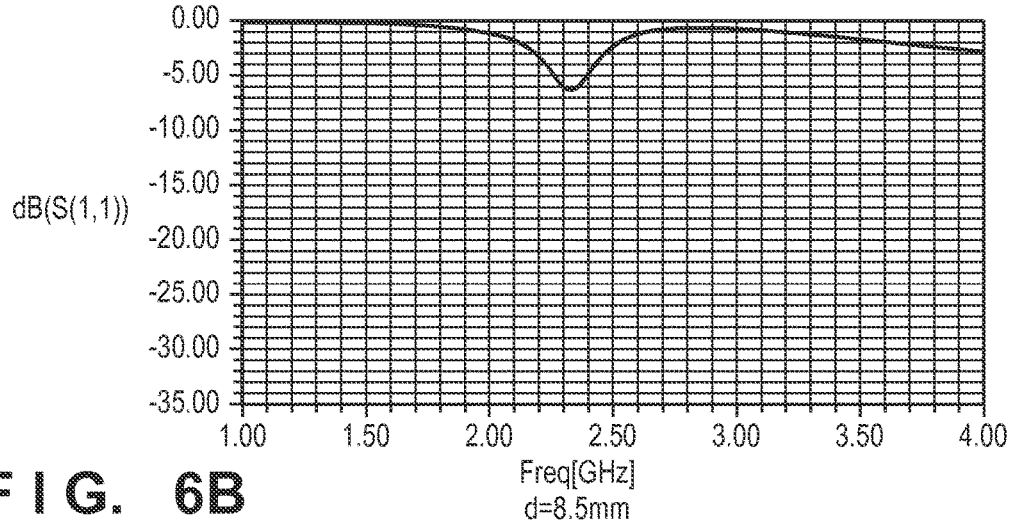
Figure 6C:
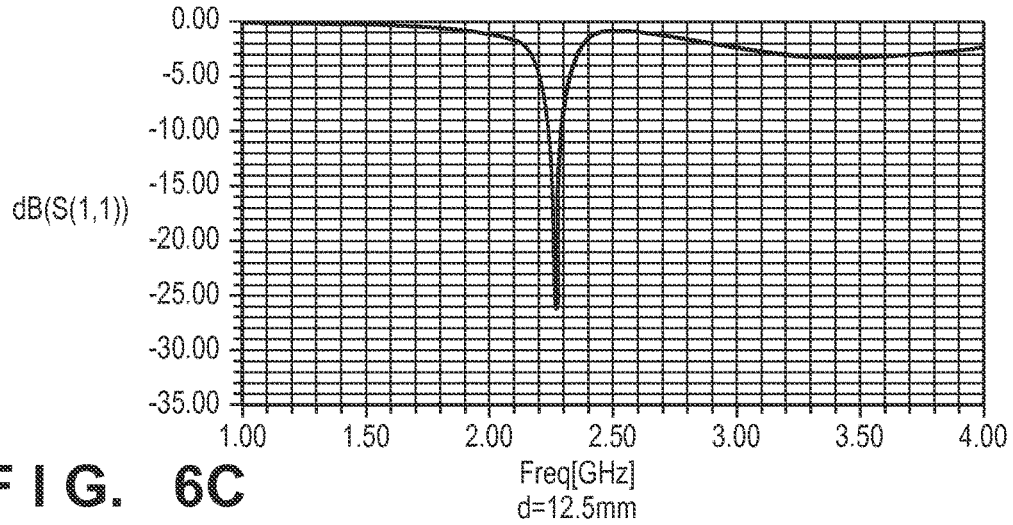

FIGS. 6A to 6C show the simulation results of the reflection characteristic (S11) of the single band antenna shown in FIGS. 5A and 5B when a length d of the conductor 504 is changed while the length of the conductor 509 is fixed to 2 mm. FIGS. 6A, 6B, and 6C respectively show the reflection characteristics (S11) of the single band antenna in FIGS. 5A and 5B when d=4.5 mm, d=8.5 mm, and d=12.5 mm. Note that in these simulations, as d increases, the open end (conductor 509) of the branch portion approaches the open end of the antenna main body portion.

It is obvious from the results shown in FIGS. 6A to 6C that as the length d increases, that is, the open end of the branch portion approaches the open end of the antenna main body portion, the operating frequency of the antenna shifts to a lower frequency. This can be because as the conductor 509 approaches the open end of the conductor 507, the strength of the coupling between the antenna main body portion and the branch portion increases. Therefore, using such an arrangement can easily change the strength of the coupling between the antenna main body portion and the branch portion and can easily downsize the antenna while ensuring a desired antenna characteristic.

Figure 7A:
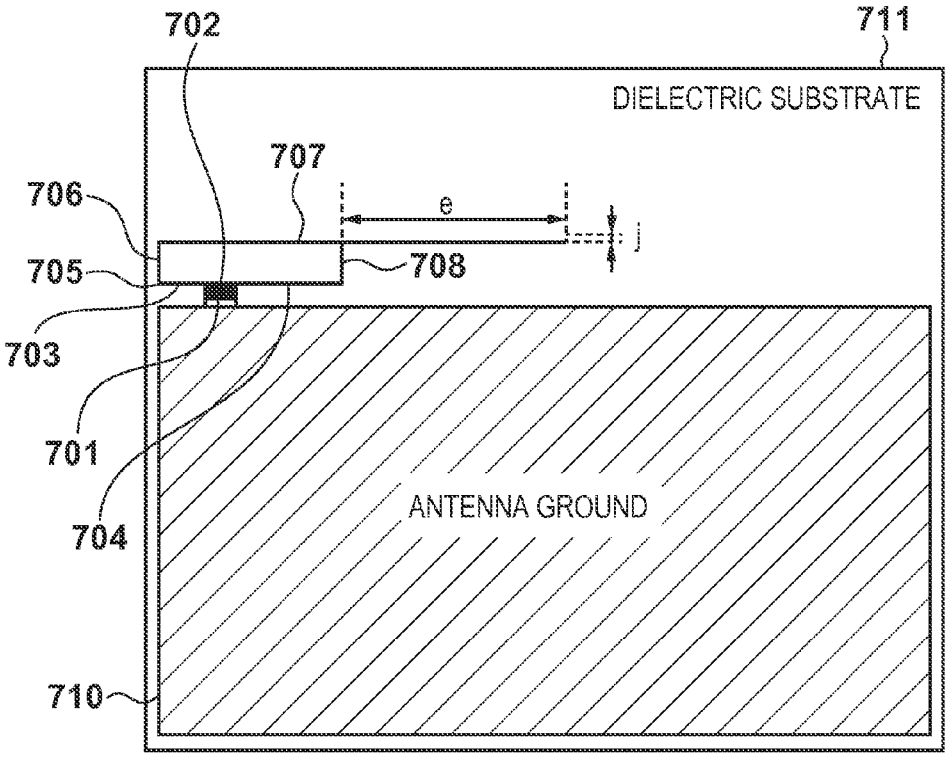
FIG. 7A is a front view showing the arrangement of another antenna according to arrangement example 1.
Figure 7B:
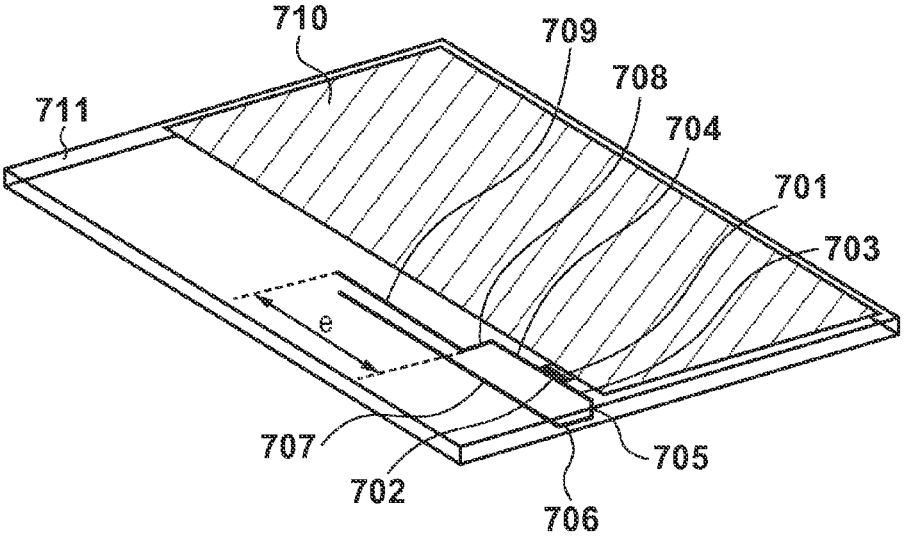
FIG. 7B is a perspective view of the antenna.

In addition, in the single band antenna shown in FIGS. 5A and 5B, it is possible to change the strength of coupling by adjusting the length of the conductor facing the branch portion when viewed from a direction perpendicular to the surface of the dielectric substrate 511. FIGS. 7A and 7B are a front view and a perspective view, respectively, of an antenna arrangement in which the facing portion has a length e. The arrangement of a feeding point 701, conductors 702 and 703, and conductors 705 to 707, which constitute an antenna main body portion in FIGS. 7A and 7B, is the same as that of the antenna main body portion of the antenna shown in FIGS. 5A and 5B. In addition, an antenna ground 710 and a dielectric substrate 711 are identical to those shown in FIGS. 5A and 5B. Note that the basic structure of a conductor 704 and conductors 708 and 709, which constitute a branch portion in FIGS. 7A and 7B, is also the same as that of the branch portion in FIGS. 5A and 5B.

Although the position of the open end of the conductor 509 of the antenna in FIGS. 5A and 5B is variable, the position of the conductor 709 of the antenna in FIGS. 7A and 7B is constant. That is, the antenna in FIGS. 7A and 7B is configured such that a length e of the conductor 709 is variable while the sum of the lengths of the conductors 704 and 709 is fixed to 18 mm.

Figure 8A:
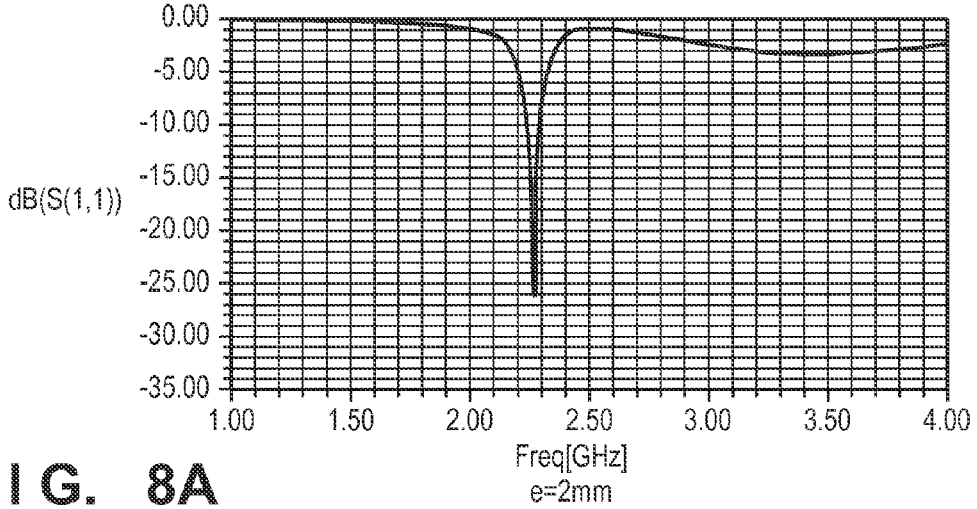
FIGS. 8A to 8C are graphs showing the simulation results of the reflection characteristic (S11) of the antenna in FIGS. 7A and 7B when the length of a portion where the distance between a branch portion and a main body portion falls within a predetermined distance is changed.
Figure 8B:
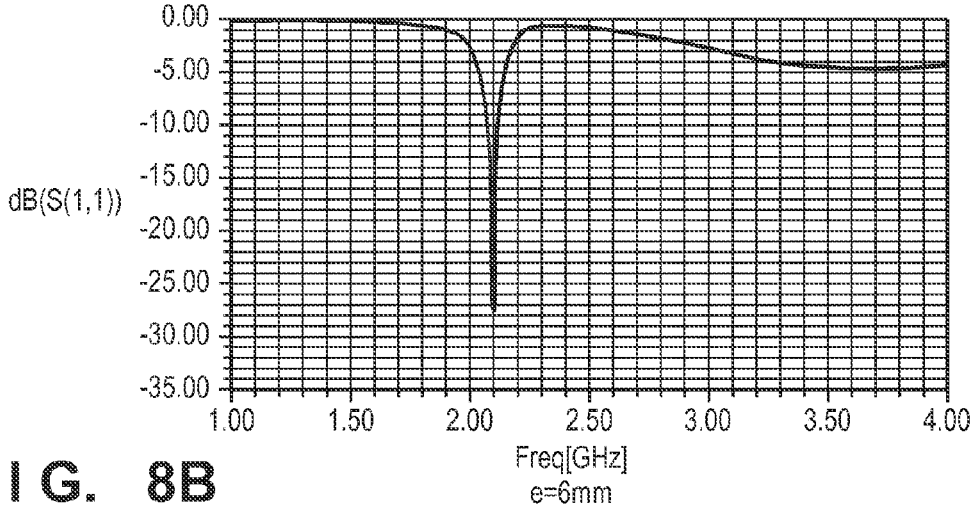
Figure 8C:
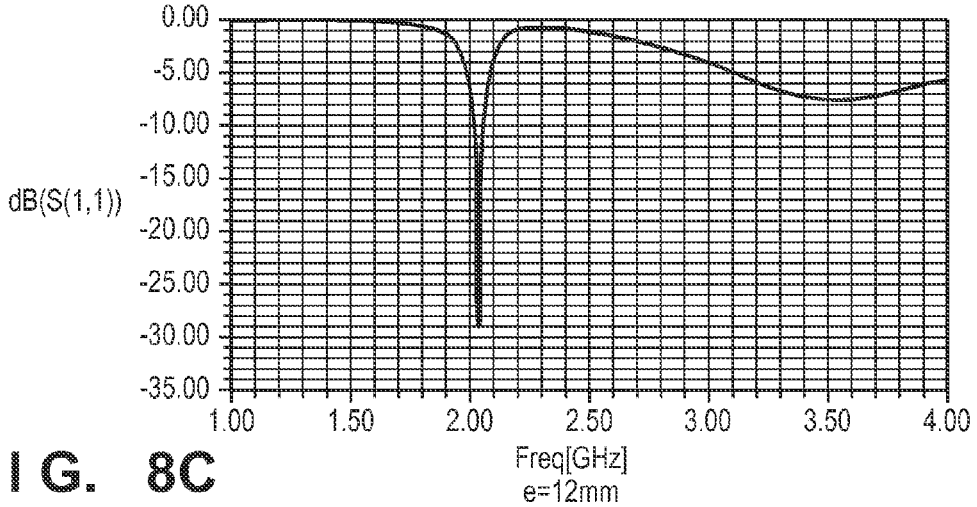

FIGS. 8A, 8B, and 8C respectively show the simulation results of the reflection characteristic (S11) of the single band antenna when the length e of the conductor 709 is changed to 2 mm, 6 mm, and 12 mm. As is obvious from FIGS. 8A to 8C, as the length e increases, the antenna operating frequency shifts to a lower frequency. This can be because the strength of the coupling between the antenna main body portion and the branch portion increases with an increase in the length of a portion where the distance between the antenna main body portion and the branch portion falls within a predetermined distance.

It is therefore possible to adjust the antenna operating frequency by changing at least one of the positional relationship between the antenna main body portion and the branch portion and the length of the portion where the distance between the antenna main body portion and the branch portion falls within a predetermined distance. In addition, in this arrangement example, the conductors of the antenna main body portion and branch portion extend from the feeding point to the respective open ends in the same direction. Since the two conductors do not extend from the feeding point to the open ends in opposite directions, the degree of freedom in designing the shapes of the two conductors forming two antenna elements greatly improves. For example, it is possible to prevent part of the antenna main body formed on the first plane from interfering with the branch portion formed on the same first plane in consideration of the design of the antenna. As a result, the shapes of the two antennas less restrict their lengths and the like to each other, and hence the degree of freedom in antenna design can be improved.

Note that the directions in which the conductors of the antenna main body portion and branch portion extend from the feeding point to the open ends need not be the same. For example, these directions may be almost the same or at least the inner product of two vectors defined by the directions in which the conductors of the antenna main body portion and branch portion extend from the feeding point to the open ends becomes a positive value. That the inner product has a positive value indicates that the angle defined by the directions in which the two conductors extend is less than 90°, thus indicating that the two conductors extend in almost the same direction.

In addition, in actual antenna design, the strength of coupling is adjusted by adjusting the length and position of each conductor in the above manner. This makes it possible to adjust the impedance in the 2.4-GHz band and allows design with a high degree of freedom. In this case, when performing design, it is important to achieve downsizing while satisfying a required antenna operating bandwidth. As described above, the antenna according to this arrangement example obtains a desired antenna characteristic by adjusting the strength of coupling, thereby implementing a low-profile, compact single band antenna with a high degree of freedom in design.

Note that according to the antennas shown in FIGS. 5A and 5B and FIGS. 7A and 7B, the conductor 304 of the branch portion near the antenna ground portion shown in FIGS. 3A and 3B is bent to make the distance between the conductor 304 and the conductor 307 of the antenna main body portion fall within a predetermined distance. However, the conductor 307 of the antenna main body portion may be bent to make the distance from the conductor 304 of the branch portion fall within a predetermined distance. Alternatively, both the conductor 304 of the branch portion and the conductor 307 of the antenna main body portion may be bent to make the distance between them fall within a predetermined distance.

Arrangement Example 2

In arrangement example 1, the strength of coupling is adjusted by changing at least one of the position and length of a portion where the inter-conductor distance between the antenna main body portion and the branch portion falls within a predetermined distance without changing the length of the antenna main body portion. As the strength of the coupling between the conductors increases, the operating frequency of the antenna shifts to a lower frequency. Arrangement example 2 will exemplify a case in which it is possible to downsize the antenna by changing the length of the antenna main body portion and the strength of coupling without changing the antenna size (2.5 mm×18 mm).

Figure 9A:
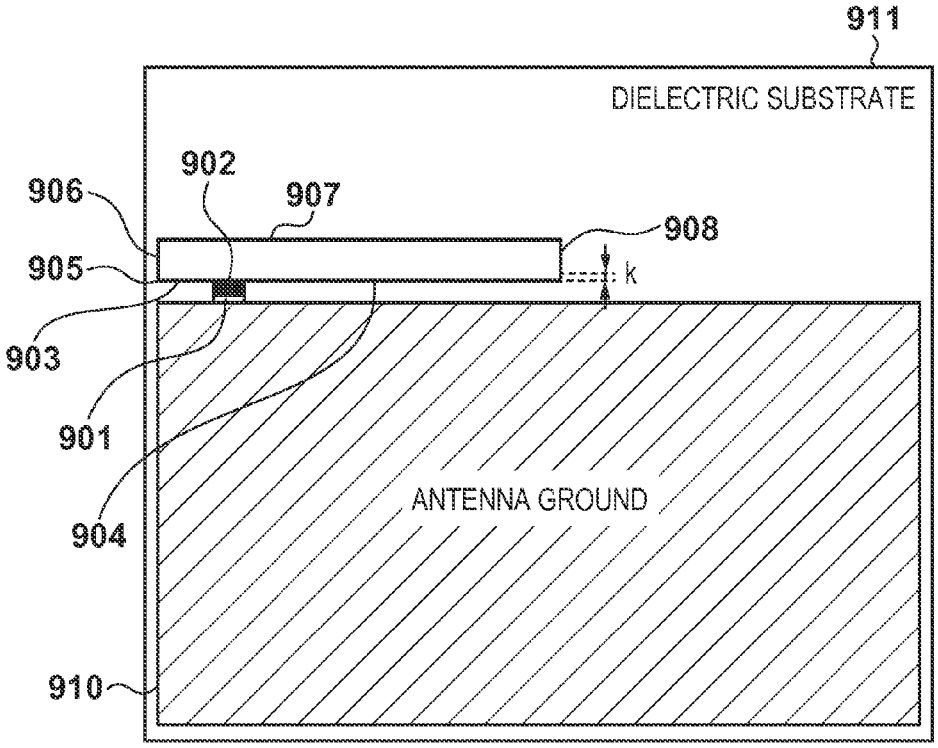
FIG. 9A is a front view showing the arrangement of an antenna according to arrangement example 2.
Figure 9B:
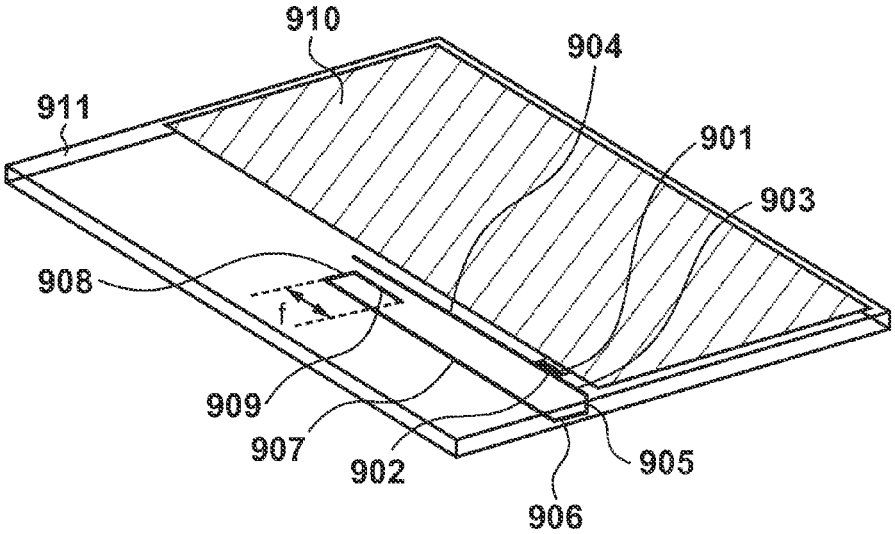
FIG. 9B is a perspective view of the antenna.

FIGS. 9A and 9B are a front view and a perspective view, respectively, of a single band antenna in this arrangement example. The antenna in FIGS. 9A and 9B includes a feeding point 901, conductors 902 to 909, an antenna ground 910, and a dielectric substrate (FR4 substrate) 911. The antenna in FIGS. 9A and 9B differs in the arrangement of the antenna main body portion (the portion constituted by the feeding point 901, the conductors 902 and 903, and the conductors 905 to 909) from the antenna shown in FIGS. 3A and 3B. That is, according to the antenna in FIGS. 9A and 9B, the direction of an open end, of the conductor 909 of the antenna main body portion, which is an end which is not connected to the conductor 908, is opposite to the direction of the open end of the conductor 904 of the branch portion, unlike in arrangement example 1.

On the other hand, the arrangement of the branch portion (the portion constituted by the feeding point 901 and the conductors 902 and 904) is the same as that of the antenna in FIGS. 3A and 3B. Note that the antenna in FIGS. 9A and 9B has an antenna size of 2.5 mm×18 mm like the antenna in FIGS. 3A and 3B, and the dielectric substrate (FR4 substrate) 911 and the antenna ground 910 are the same as those of the antenna shown in FIGS. 1A and 1B. In addition, the thickness of the substrate including the dielectric substrate and the conductors is also 0.896 mm.

In the antenna in FIGS. 9A and 9B, the distance between the conductor 904 of the branch portion and the conductor 909 of the antenna main body portion falls within a predetermined distance, and the conductors are coupled strongly. In this arrangement example, in order to obtain high coupling strength, the conductors 904 and 909 face each other when viewed from a direction perpendicular to the surface of the dielectric substrate. Note that the reason why FIG. 9A does not show the conductor 909 is that it has the same line width as that of the conductor 904, and overlaps it. Although in this arrangement example, the conductor 909 is arranged to face the conductor 904 when viewed from a direction perpendicular to the surface of the dielectric substrate 911, the present invention is not limited to this. That is, the conductor 909 may just be arranged within a predetermined distance from the conductor 904 or arranged at a position closer to the conductor 904 than other portions of the branch portion.

In the antenna arrangement in FIGS. 9A and 9B, the length of the antenna main body portion is adjusted to allow the operating frequency band to be adjusted by adjusting the antenna length itself, and the operating frequency band can be adjusted by adjusting the strength of coupling. More specifically, a length f of the conductor 909 in FIGS. 9A and 9B is changed to change the length of a portion where the distance from the conductor 904 of the branch portion falls within a predetermined distance, together with the length of the antenna main body portion, thereby adjusting the operating frequency band.

Figure 10A:
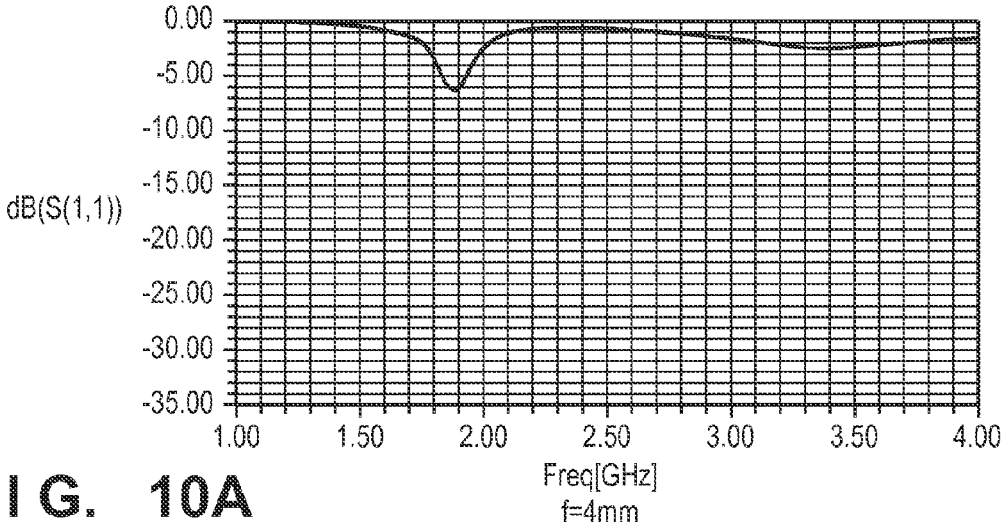
FIGS. 10A to 10C are graphs showing the simulation results of the reflection characteristic (S11) of the antenna in FIGS. 9A and 9B when the length of a portion where the distance between a branch portion and a main body portion falls within a predetermined distance is changed.
Figure 10B:
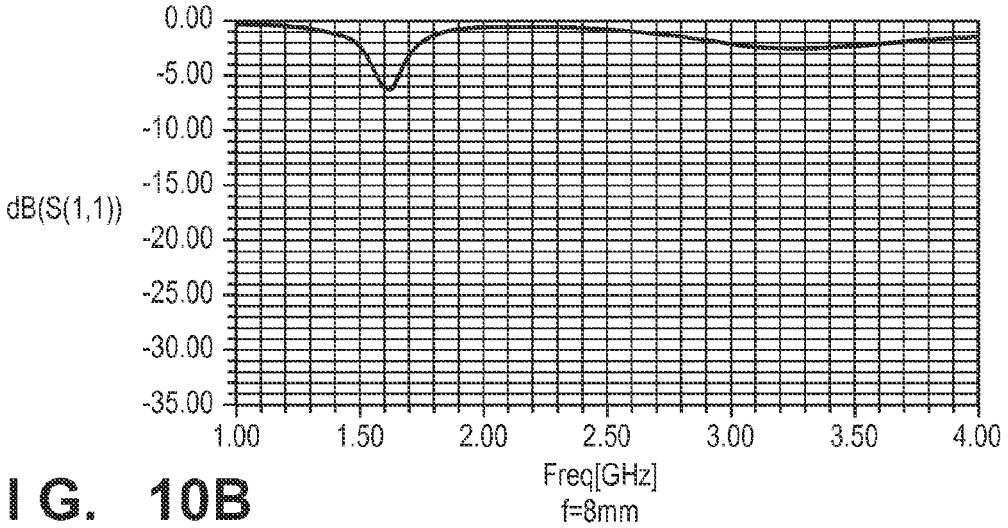
Figure 10C:
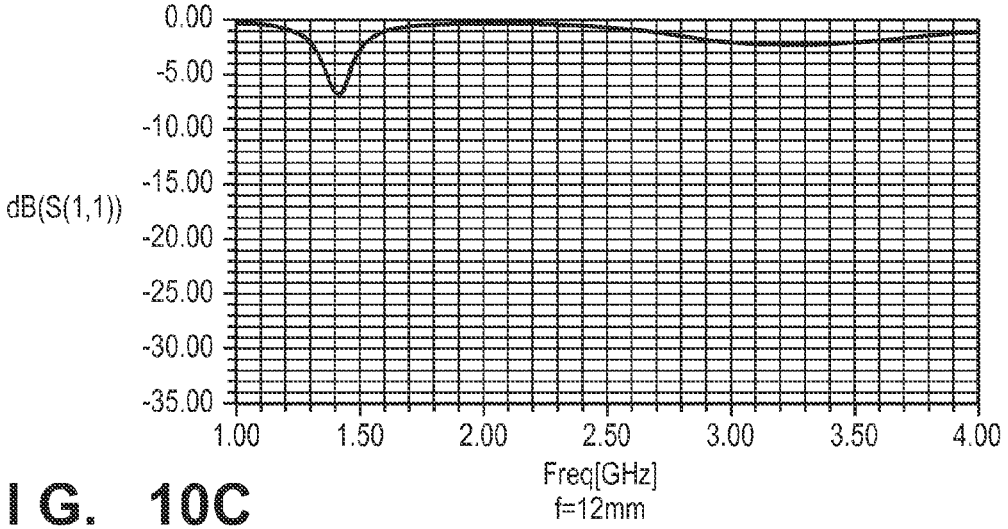

FIGS. 10A to 10C respectively show the simulation results of the reflection characteristic (S11) when the length f of the conductor 909 as part of the antenna main body portion is used as a parameter. FIGS. 10A, 10B, and 10C respectively show the simulation results obtained when f=4 mm, f=8 mm, and f=12 mm. It can be confirmed from FIGS. 10A to 10C that as the strength of coupling increases, the length of the antenna main body portion increases, and hence the antenna operating frequency band shifts to a lower frequency. It was found from these results that, like arrangement example 1, this arrangement example could achieve a reduction in antenna size.

Figure 11:
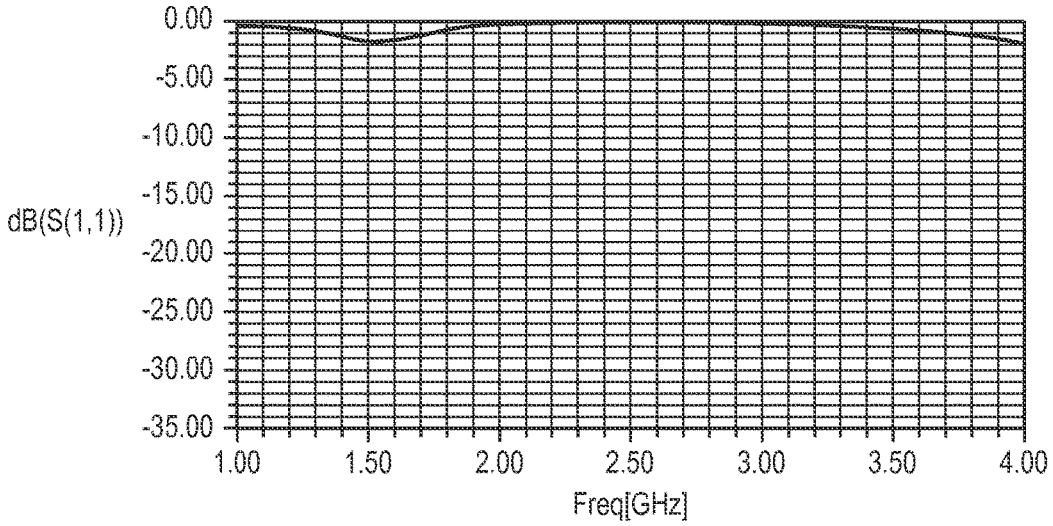
FIG. 11 is a graph showing the simulation result of the reflection characteristic (S11) of the antenna in FIGS. 9A and 9B without any branch portion.

For comparison, FIG. 11 shows the simulation result of the reflection characteristic (S11) of the antenna in FIGS. 9A and 9B without any branch portion. Note that a length f at this time was 12 mm. It can be confirmed from the comparison between the simulation result in FIG. 11 and the simulation result in FIG. 10C that the antenna operating frequency in FIG. 11 shifts to a higher frequency. This can be because, in the antenna arrangement shown in FIGS. 9A and 9B, as in arrangement example 1, the operating frequency shifts due to a change in coupling.

Note that in this arrangement example, the conductors of the antenna main body portion and branch portion extend from the feeding point to the respective open ends in opposite directions. This arrangement makes it possible to increase the length of the antenna main body portion while keeping the overall size of the antenna unchanged. In addition, the arrangement shown in FIGS. 9A and 9B can flexibly change the strength of coupling. An antenna like that of this arrangement example makes it possible to ensure a high degree of freedom in design while achieving the downsizing of the antenna.

Note that the directions in which the conductors of the antenna main body portion and branch portion extend from the feeding point to the respective open ends need not be opposite directions. For example, these directions may just be almost opposite to each other. Alternatively, the inner product of two vectors defined by the directions in which the conductors of the antenna main body portion and branch portion extend from the feeding point to the open ends may just become a negative value. That the inner product has a negative value indicates that the angle defined by the directions in which the two conductors extend is larger than 90°, thus indicating that the two conductors extend in almost opposite directions.

Arrangement Example 3

Figure 12A:
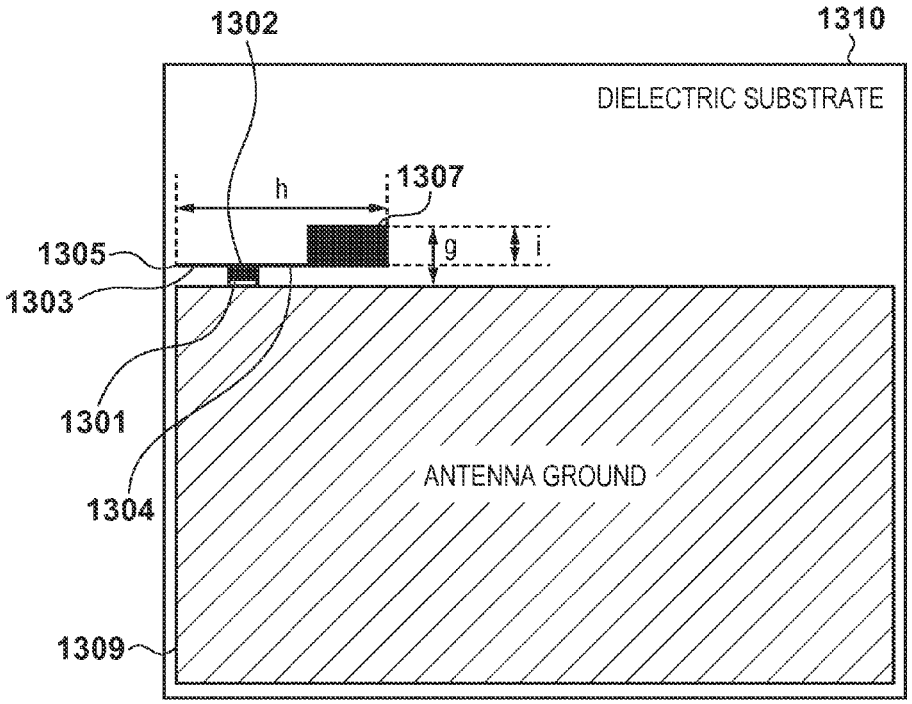
FIG. 12A is a front view showing the arrangement of an antenna according to arrangement example 3.
Figure 12B:
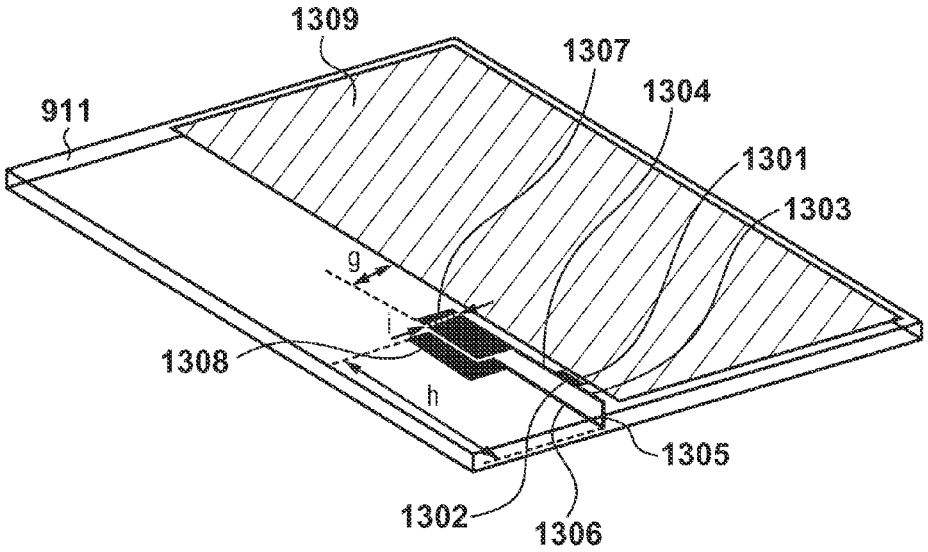
FIG. 12B is a perspective view of the antenna.

FIGS. 12A and 12B are a front view and a perspective view, respectively, of a single band antenna according to this arrangement example. The antenna size is 2.5 mm×10 mm. As shown in FIGS. 12A and 12B, the antenna according to this arrangement example includes a feeding point 1301, conductors 1302 to 1308, an antenna ground 1309, and a dielectric substrate (FR4 substrate) 1310. The dielectric substrate (FR4 substrate) 1310 and the antenna ground 1309 of the antenna in FIGS. 12A and 12B are identical to those of the antenna shown in FIGS. 1A and 1B. The thickness of the substrate including the dielectric substrate and the conductors is also 0.896 mm.

The antenna in FIGS. 12A and 12B differs in the shapes of the antenna main body portion and branch portion from the antenna in FIGS. 3A and 3B. However, these antennas are the same in that the branch portion is formed on the front surface of the dielectric substrate, the antenna main body is formed astride the front and back surfaces of the dielectric substrate, and the characteristic of the antenna is adjusted by adjusting the coupling between the main body portion and the branch portion.

The antenna in FIGS. 12A and 12B includes an antenna main body portion and a branch portion, like the antenna in FIGS. 3A and 3B. The antenna main body portion is constituted by the feeding point 1301 and the conductors 1302, 1303, 1305, 1306, and 1308. The branch portion is constituted by the feeding point 1301 and the conductors 1302, 1304, and 1307. In this case, the conductor 1308 including the open end of the antenna main body portion and the conductor 1307 including the open end of the branch portion have larger conductor widths than the remaining conductors.

Although the following will describe a case in which the conductor width of a conductor including an open end is larger than that of other conductors, the conductor width of a conductor including no open end may be larger than that of other conductors as long as coupling can be obtained between the antenna main body portion and the branch portion. In the following description, conductors having large conductor widths are formed in the same shape and size at the antenna main body portion and the branch portion. However, such conductors need not have the same shape and size as long as coupling can be obtained. For example, a conductor having a large conductor width may be formed at only one of the antenna main body portion and the branch portion. Furthermore, in the following description, each conductor having a large conductor width is rectangular. However, such conductors may have shapes other than rectangular, such as circular and triangular.

In addition, the conductors 1307 and 1308 are arranged to face each other when viewed from a direction perpendicular to the surface of the dielectric substrate, and so are the conductors 1304 and 1306. Note that the reason why FIG. 12A does not show the conductors 1306 and 1308 is that they have the same line widths as those of the conductors 1303, 1304, and 1307, and overlap them. This can increase the strength of the coupling between the antenna main body portion and the branch portion. Note that in this arrangement example, the conductors 1307 and 1308 are arranged to face each other when viewed from a direction perpendicular to the surface of the dielectric substrate 1310, and so are the conductors 1304 and 1306. However, the present invention is not limited to this. That is, these conductors may be arranged such that the distances between them fall within a predetermined distance.

Figure 13A:
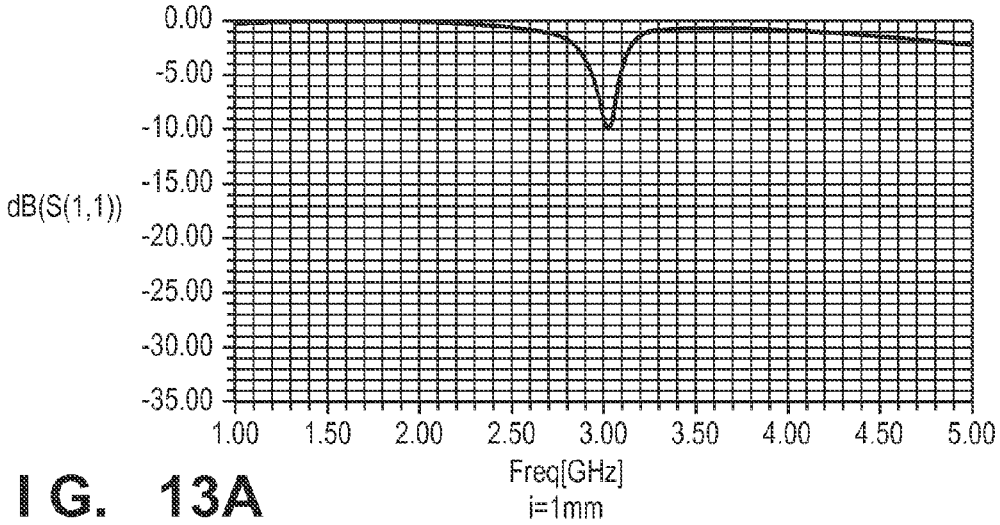
FIGS. 13A to 13C are graphs showing the simulation results of the reflection characteristic (S11) of the antenna in FIGS. 12A and 12B when a conductor width is changed.
Figure 13B:
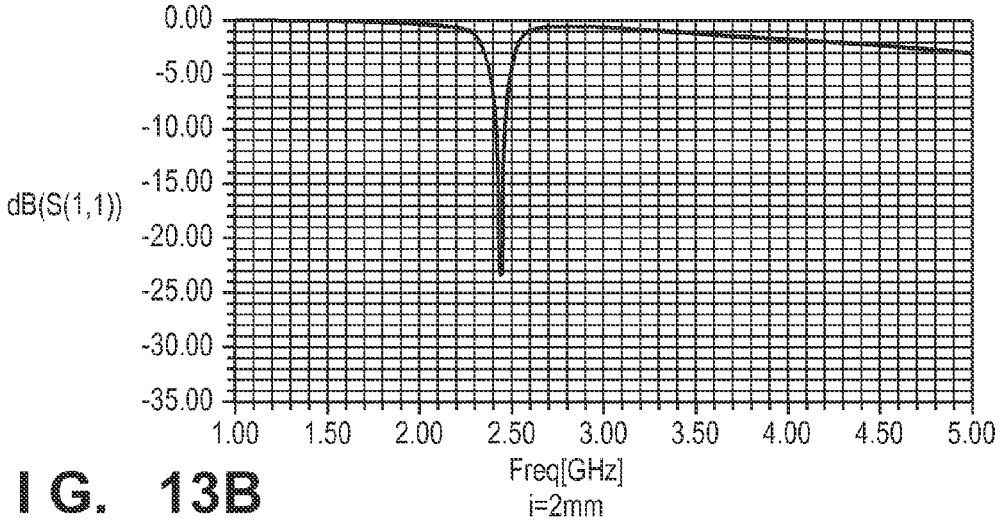
Figure 13C:
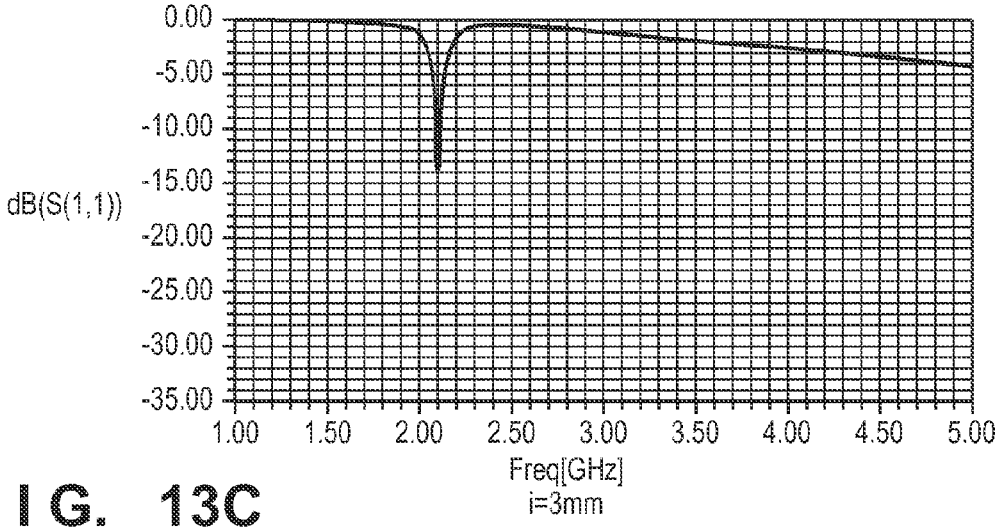

According to the antenna arrangement in FIGS. 12A and 12B, it is possible to adjust the strength of the coupling between the antenna main body portion and the branch portion by changing a conductor width i of an open end portion. FIGS. 13A and 13C show the simulation results of the reflection characteristic (S11) of the antenna in FIGS. 12A and 12B when the conductor width i of the open end portions of the antenna main body portion and branch portion is changed. FIGS. 13A, 13B, and 13C respectively show the simulation results when i=1 mm, i=2 mm, and i=3 mm. As is obvious from FIGS. 13A to 13C, as the conductor width i of the open end portions increases, the operating frequency shifts to a lower frequency. This is because the strength of the coupling between the conductors 1307 and 1308 respectively including the open ends of the branch portion and antenna main body portion increases.

As the frequency decreases, the wavelength increases, and the antenna generally increases in size. However, according to the antenna shown in FIGS. 12A and 12B, it is possible to shift the frequency to a lower frequency while the length h in the lateral direction is fixed. For this reason, providing the conductors 1307 and 1308 having large conductor widths can achieve the downsizing of the antenna in the lateral direction.

In addition, as is obvious from FIG. 13B, when i=2 mm, a satisfactory reflection characteristic can be obtained in the 2.4-GHz band used in IEEE802.11b/g/n, and a bandwidth in which the reflection characteristic is −6 dB or less can be ensured by about 85 MHz. Since the bandwidth required for a wireless LAN is about 70 MHz, the operating bandwidth required for a wireless LAN can be ensured. That is, the antenna shown in FIGS. 12A and 12B can ensure an operating bandwidth satisfying the operating bandwidth required for a wireless LAN as a 2.4-GHz band antenna when i=2 mm. In this case, when i=2 mm, a length g of the antenna in FIG. 12A in the longitudinal direction is 2.5 mm, and a length h in the lateral direction is 10 mm. That is, the antenna size is 2.5 mm×10 mm. Considering a pattern antenna in the 2.4-GHz band used in IEEE802.11b/g/n, this size is smaller than those of conventional antennas.

As described above, with the arrangement of the single band antenna shown in FIGS. 12A and 12B, the magnitude of coupling is adjusted by adjusting the conductor widths of the conductors 1307 and 1308, each including the open end, thereby adjusting the operating frequency band. It is therefore possible to implement a compact single band antenna with a high degree of freedom in design by using the antenna arrangement in FIGS. 12A and 12B.

Figure 14A:
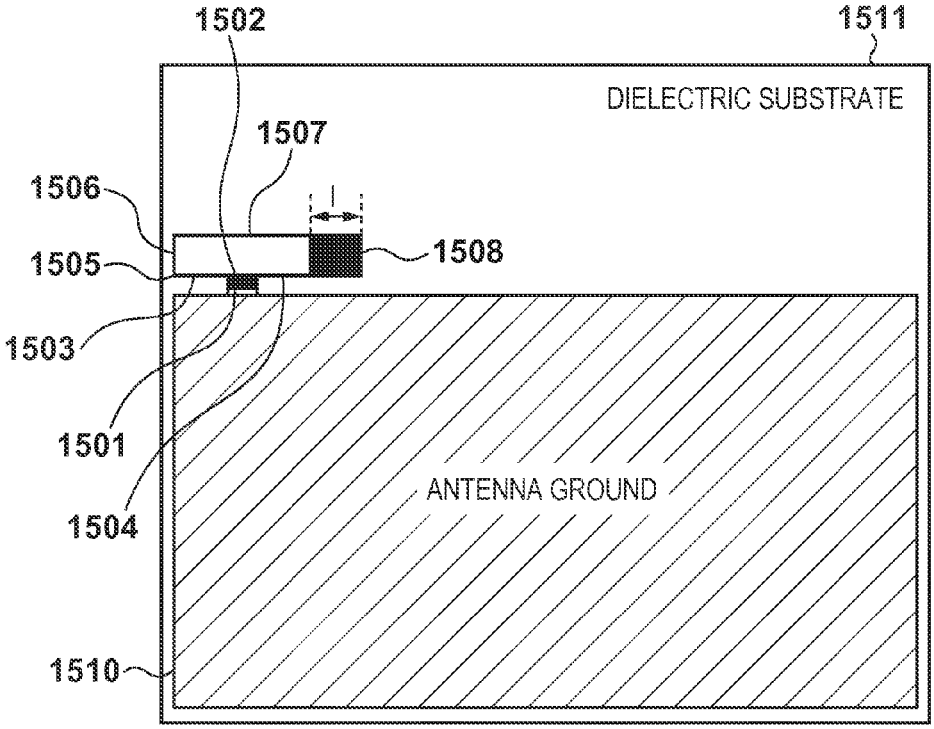
FIG. 14A is a front view showing the arrangement of another antenna according to arrangement example 3.
Figure 14B:
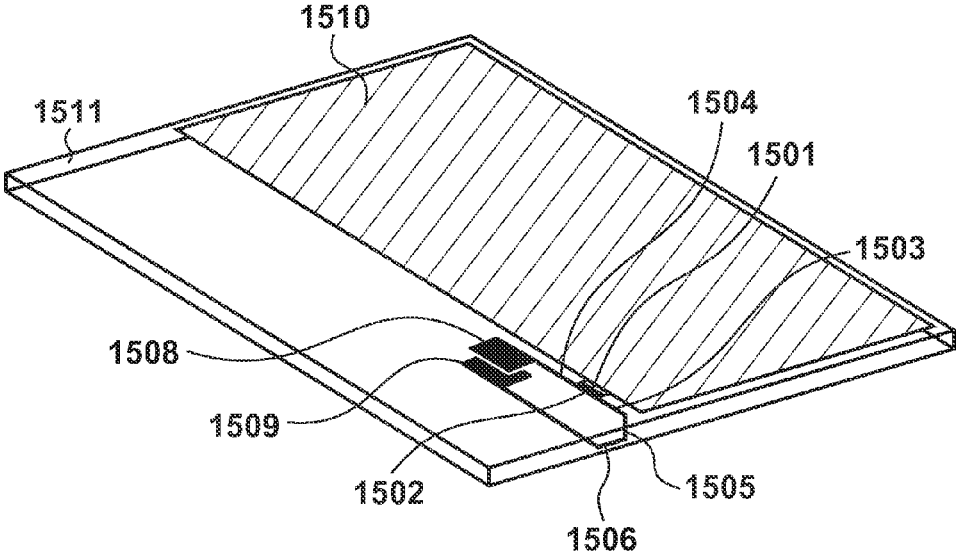
FIG. 14B is a perspective view of the antenna.

Note that in the arrangement example described above, not only the conductors 1307 and 1308 including the open ends but also the conductors 1304 and 1306 of the branch portion and antenna main body portion are arranged to face each other through the dielectric substrate. However, the present invention is not limited to this arrangement. For example, as shown in FIGS. 14A and 14B, only conductors 1508 and 1509 including open ends may be arranged to face each other or approach each other within a predetermined distance. FIGS. 14A and 14B are a front view and a perspective view, respectively, of an antenna configured such that only the conductors 1508 and 1509 including the open ends are arranged to face each other when viewed from a direction perpendicular to the surface of the dielectric substrate, after the widths of the conductors are made larger than those of other conductors.

The arrangement of the antenna shown in FIGS. 14A and 14B is the same as that of the antenna shown in FIGS. 3A and 3B except that the conductors of the antenna main body portion and branch portion which include open ends are made to have conductor widths larger than those of other conductors by a predetermined length. In this case, increasing the conductor widths of the conductors including the open ends (the conductors 1508 and 1509) can make the distance between the conductors through the dielectric substrate fall within a predetermined distance. This makes it possible to increase the strength of the coupling between these conductors and adjust the operating frequency band.

Note that the length of the antenna main body portion of the antenna shown in FIGS. 14A and 14B is larger than that of the antenna in FIGS. 12A and 12B by a connected conductor 1506. For this reason, in order to adjust the operating frequency to 2.4 GHz, it is important to adjust the strength of the coupling between the antenna main body portion and the branch portion. For this reason, the antenna shown in FIGS. 14A and 14B allows the operating frequency to be adjusted by adjusting the strength of coupling by adjusting the sizes of the conductors 1508 and 1509.

Figure 15:
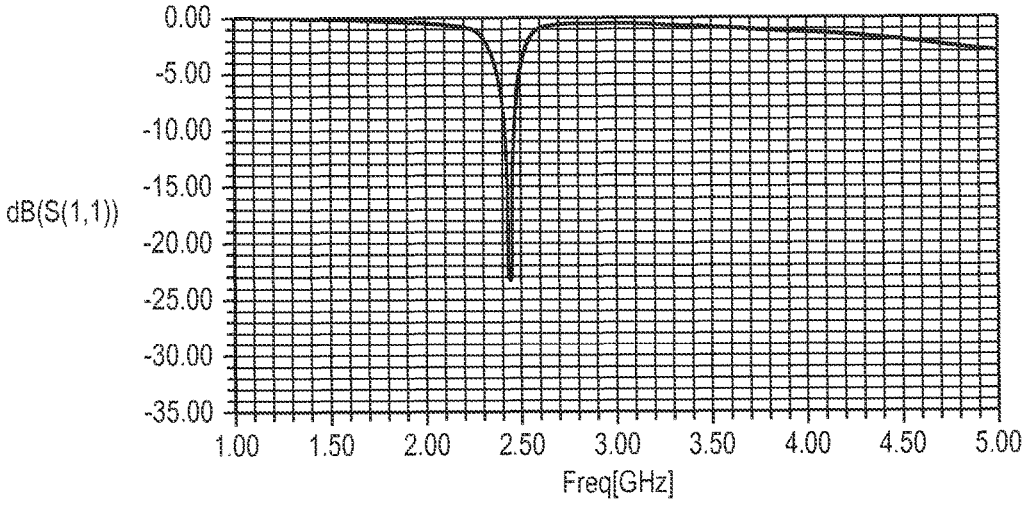
FIG. 15 is a graph showing the simulation result of the reflection characteristic (S11) of the antenna in FIGS. 14A and 14B.

FIG. 15 shows the simulation result of the reflection characteristic (S11) of the single band antenna shown in FIGS. 14A and 14B after the sizes of the conductors 1508 and 1509 are adjusted as an antenna operating in the 2.4-GHz band. As is obvious from FIG. 15, the antenna shown in FIGS. 14A and 14B can obtain a satisfactory reflection characteristic in the 2.4-GHz band in IEEE802.11b/g/n and ensure a bandwidth of about 100 MHz in which the reflection characteristic is −6 dB or less. Note that in this case, the size of each of the conductors 1508 and 1509 is 2 mm×2.38 mm, and the antenna size is 2.5 mm×8.58 mm. That is, the antenna in FIGS. 14A and 14B is smaller in size than even the antenna in FIGS. 12A and 12B. Therefore, it is possible to implement a compact single band antenna with a high degree of freedom in design as compared with the antenna shown in FIGS. 14A and 14B.

The basic form of the single band antenna according to this embodiment and the three different arrangement examples have been described above. Although this embodiment has exemplified the case in which all the conductors of the basic form and the respective arrangement examples are linear or rectangular, the present invention is not limited to this. For example, at least part of a conductor may be formed into a curve or circular shape or may be formed into a shape that can obtain a high inductance value in the conductor, such as a meander line shape.

In addition, this embodiment has exemplified the case in which the first and second planes on which the antenna main body portion and the branch portion are formed respectively correspond to the front and back surfaces of one dielectric substrate. However, the present invention is not limited to this. For example, the first and second planes may respectively correspond to planes between different layers of a multilayer substrate. The first plane may be a plane between the first and second layers of the multilayer substrate, and the second plane may be a plane between the second and third layers of the substrate.

In addition, this embodiment has exemplified the single band antenna formed from the pattern formed on the FR4 substrate. However, the present invention is not limited to this. For example, a single band antenna may be formed from a sheet metal or conductive wire or may be formed from a conductive wire in a high-dielectric member such as a ceramic member. Furthermore, the embodiment has exemplified only the feeding point in association with power feeding to the dual band antenna of the embodiment, but there has been no detailed description of the feeder to the feeding point. However, such a feeder is not specifically limited. For example, it is possible to use a planar circuit typified by a microstrip line, slot line, or coplanar line or a transmission line which transmits electromagnetic waves, such as a coaxial line or waveguide.

Second Embodiment

The first embodiment has exemplified the single band antenna which operates in the 2.4-GHz band complying with the a wireless LAN standard (for example, IEEE802.11b/g/n). Recently, a wireless communication function complying with, for example, a wireless LAN standard (for example, IEEE802.11a/b/g/n) has been mounted on an electronic device. An antenna used for this function is required to operate in both the 2.4-GHz band and the 5-GHz band. In addition, as described above, since an antenna is required to be downsized, one antenna is required to have a plurality of operating bands, that is, function as a dual band antenna.

Under the circumstances, this embodiment will exemplify a case in which a dual band antenna complying with a wireless LAN standard (for example, IEEE802.11a/b/g/n) can be implemented by an antenna structure similar to those of the antennas shown in FIGS. 7A and 7B, 9A and 9B, and 14A and 14B. In this case, the antenna main body portion in the first embodiment contributes to the 2.4-GHz band as the first antenna, and the branch portion contributes to the 5-GHz band as the second antenna. Note that if the length and line width of each antenna in the first embodiment are used without any change, the antenna does not match the operating frequency bands. For this reason, the lengths and line widths of the conductors of these antennas are adjusted with respect to the state in the first embodiment to make the antenna operate as a dual band antenna.

Figure 16A:
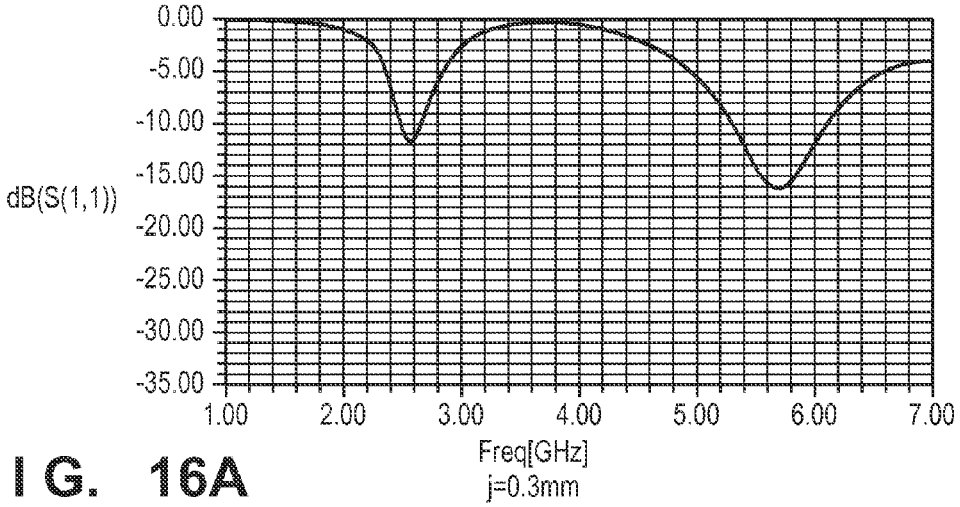
FIGS. 16A to 16C are graphs showing the simulation results of the reflection characteristic (S11) of the dual band antenna having a structure similar to that of the antenna in FIGS. 7A and 7B when a conductor width is changed.
Figure 16B:
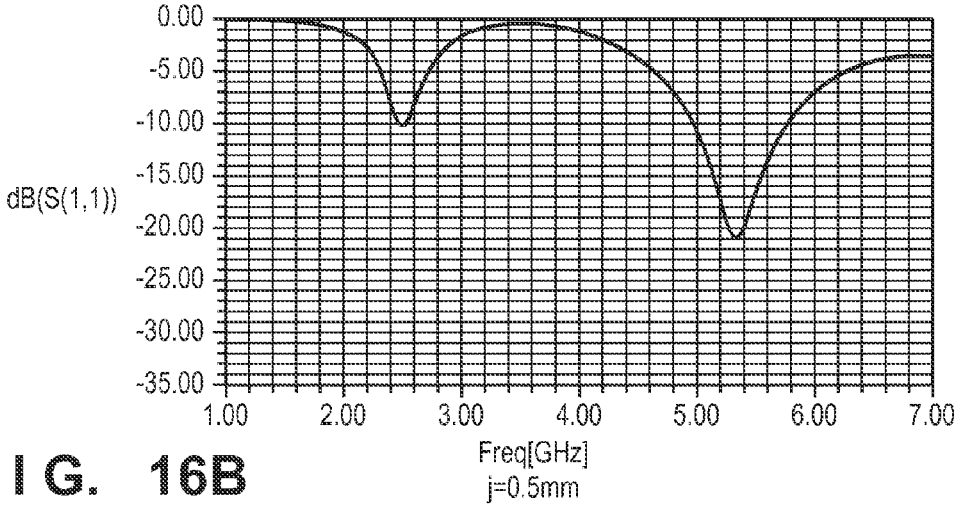
Figure 16C:
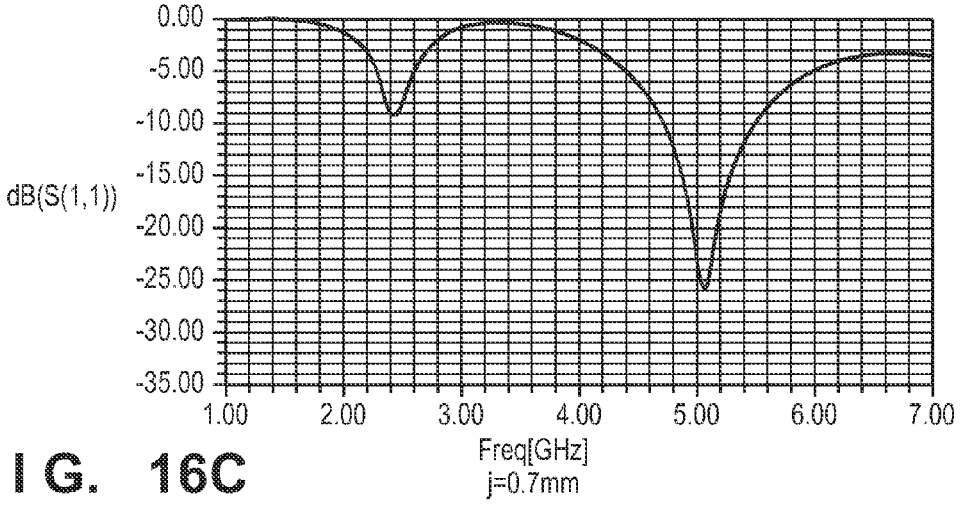

FIGS. 16A to 16C show the simulation results of the reflection characteristic (S11) of a dual band antenna having the same structure as that shown in FIGS. 7A and 7B when a line width j shown in FIG. 7A is changed. FIGS. 16A, 16B, and 16C respectively show reflection characteristics (S11) when j=0.3 mm, j=0.5 mm, and j=0.7 mm. As is obvious from FIGS. 16A to 16C, as the line width j increases, both the 2.4-GHz band the 5-GHz band as operating bands shift to lower frequencies. This can be because as the line width increases, the strength of the coupling between the conductors 707 and 709 in FIG. 7B increases, and both the antenna operating frequencies on the lower-frequency side and the higher-frequency side shift to lower frequencies.

Note that in the case of the dual band antenna having the characteristic shown in FIG. 16B, the antenna size is 5.5 mm×14.7 mm. Obviously, therefore, an antenna structure like that shown in FIGS. 7A and 7B can implement a compact dual band antenna which operates in both the 2.4-GHz band and the 5-GHz band as frequency bands complying with a wireless LAN standard (for example, IEEE802.11a/b/g/n).

Figure 17A:
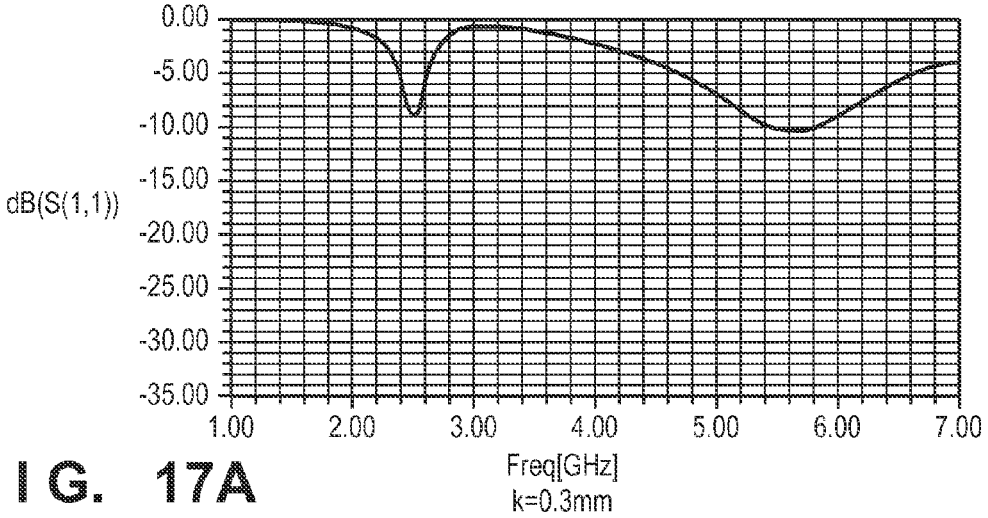
FIGS. 17A to 17C are graphs showing the simulation results of the reflection characteristic (S11) of the dual band antenna having a structure similar to that of the antenna in FIGS. 9A and 9B when a conductor width is changed.
Figure 17B:
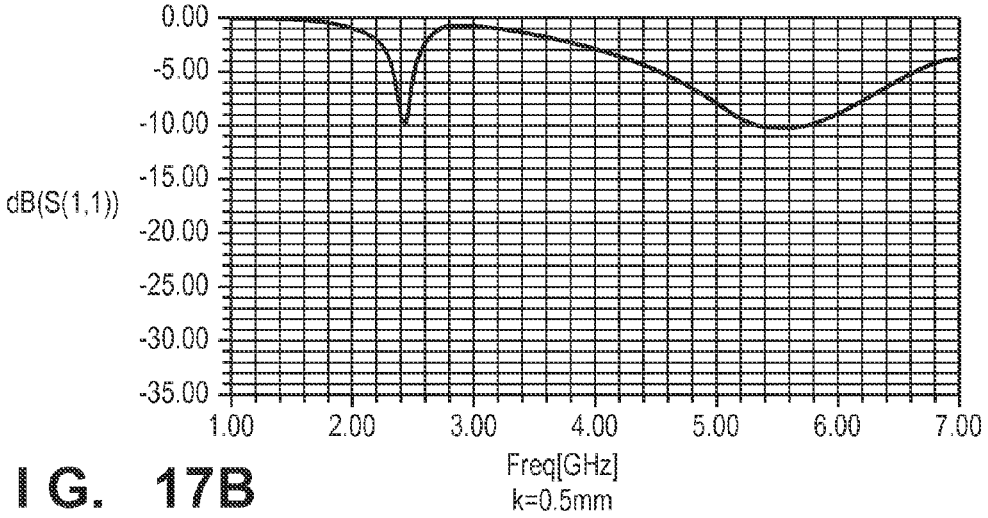
Figure 17C:
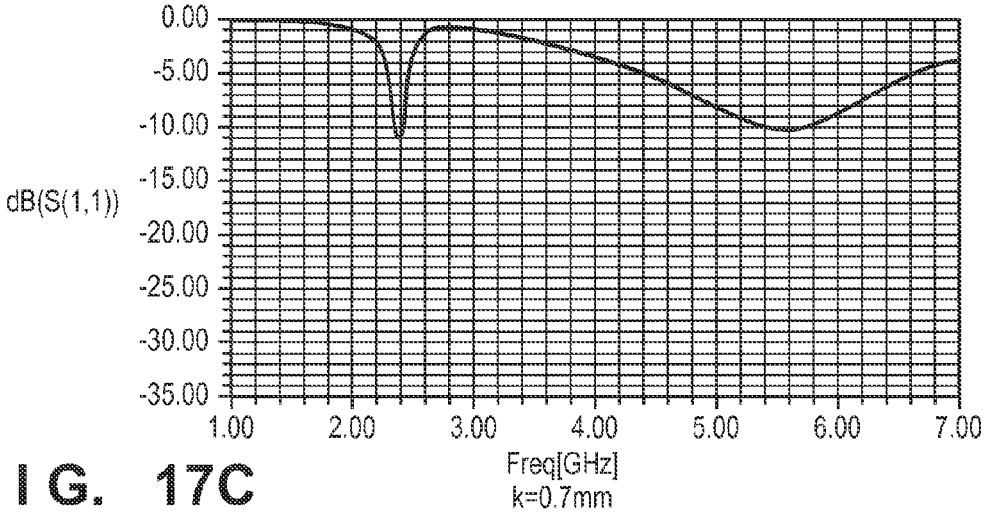

FIGS. 17A to 17C show the simulation results of the reflection characteristic (S11) of the dual band antenna having the same structure as that shown in FIGS. 9A and 9B when a line width k shown in FIG. 9A is changed. FIGS. 17A, 17B, and 17C respectively show the reflection characteristics (S11) when k=0.3 mm, k=0.5 mm, and k=0.7 mm. As is obvious from FIGS. 17A to 17C, as a line width w increases, both the 2.4-GHz band the 5-GHz band as operating bands shift to lower frequencies. This can be because as the line width increases, the strength of the coupling between the conductors 909 and 904 in FIG. 9B increases, and both the antenna operating frequencies on the lower-frequency side and the higher-frequency side shift to lower frequencies.

Note that in the case of the dual band antenna having the characteristic shown in FIG. 17B, the antenna size is 3.5 mm×11.0 mm. Therefore, it is obvious that an antenna structure like that shown in FIGS. 9A and 9B can also implement a compact dual band antenna which operates in both the 2.4-GHz band and the 5-GHz band as frequency bands complying with a wireless LAN standard (for example, IEEE802.11a/b/g/n). In addition, this dual band antenna can be formed with an antenna size smaller than that of an antenna structure like that shown in FIGS. 7A and 7B. This can be because providing the conductors 908 and 909 allow the conductor contributing to the lower-frequency side to have an antenna length larger than that in the antenna arrangement shown in FIGS. 5A and 5B.

Figure 18A:
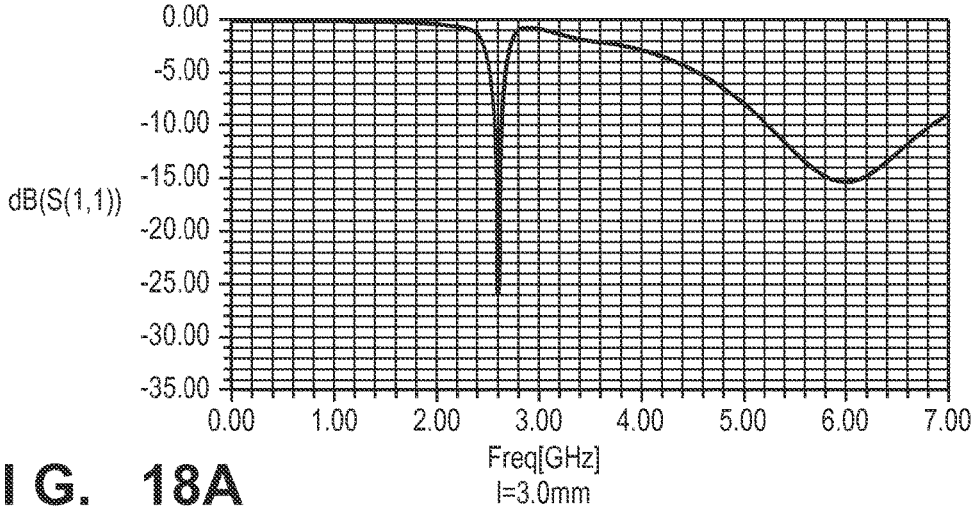
FIGS. 18A to 18C are graphs showing the simulation results of the reflection characteristic (S11) of the dual band antenna having a structure similar to that of the antenna in FIGS. 14A and 14B when a conductor width is changed.
Figure 18B:
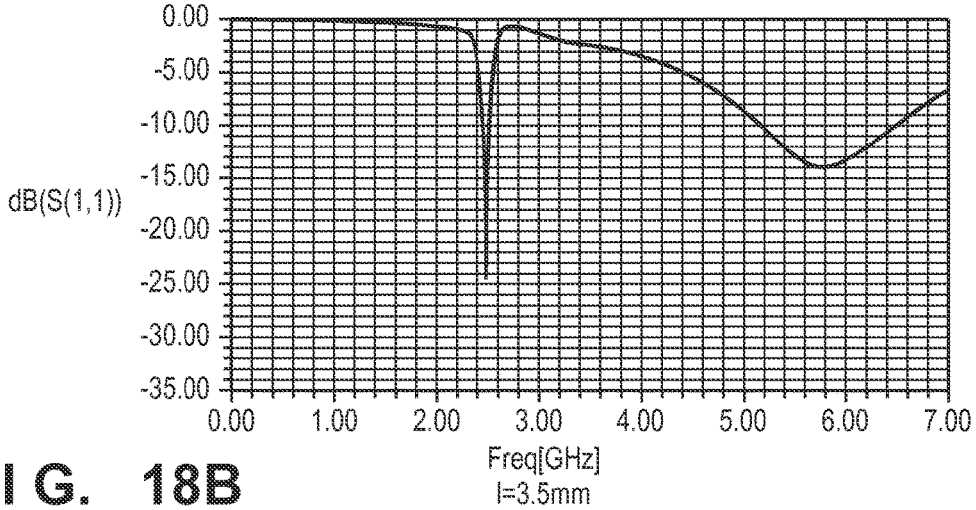
Figure 18C:
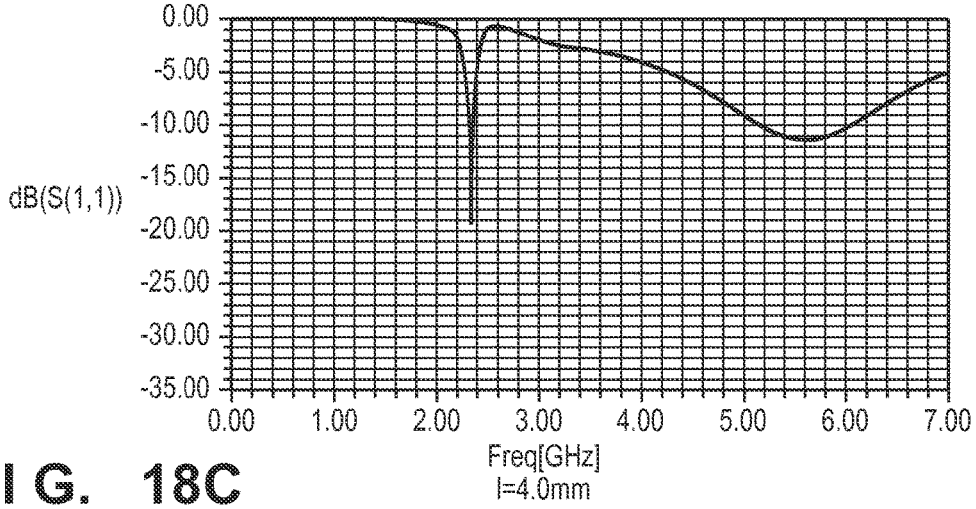

FIGS. 18A to 18C respectively show the simulation results of the reflection characteristic (S11) of the dual band antenna having the same structure as that shown in FIGS. 14A and 14B when a line width l shown in FIG. 14A is changed. FIGS. 18A, 18B, and 18C respectively show the reflection characteristics (S11) when l=3.0 mm, l=3.5 mm, and l=4.0 mm. As is obvious from FIGS. 18A to 18C, as the line width (conductor width) l increases, both the 2.4-GHz band and the 5-GHz band as operating bands shift to lower frequencies. This may be cause as the line width increases, the strength of the coupling between conductors 1508 and 1509 in FIG. 14B increases, and both the antenna operating frequencies on the lower-frequency side and the higher-frequency side shift to lower frequencies.

Note that in the case of the dual band antenna having the characteristic shown in FIG. 18B, the antenna size is 3.5 mm×9.5 mm. Therefore, it is obvious that an antenna structure like that shown in FIGS. 14A and 14B can also implement a compact dual band antenna which operates in both the 2.4-GHz band and the 5-GHz band as frequency bands complying with a wireless LAN standard (for example, IEEE802.11a/b/g/n). Note that this dual band antenna can be formed with an antenna size smaller than that of an antenna structure like that shown in FIGS. 7A and 7B or FIGS. 9A and 9B. This can be because providing the conductors 1508 and 1509 which have large line widths (conductor widths) and face each other can generate strong coupling between the conductors 1508 and 1509.

Note that it is possible to form a multiband antenna corresponding to three or more frequency bands by increasing the number of branches of each antenna described above. The conductors corresponding to the respective frequency bands may be respectively arranged on three or more different layers or conductors corresponding to some frequency bands may be arranged on the same layer while other conductors may be arranged on other layers. Alternatively, a plurality of frequency bands may be grouped, and antenna conductors corresponding to each group may be arranged on the same layer.

In the above embodiment, the coupling portions of the two conductors are formed on the two surfaces of the dielectric substrate. The effects of this dielectric substrate will be described. The effects of the coupling between the two conductors have already been described above. Since the inter-conductor distance between the coupling portions of the two conductors is regarded to influence both the strength of coupling and the antenna characteristic, the antenna can have a structure which can keep a predetermined inter-conductor distance. If no conductor is formed on a dielectric substrate, since the conductors of an antenna have no structure for holding shapes, the conductors may be deformed by contact with them at the time of manufacture, deterioration with time, or the like. This may lead to a change in inter-conductor distance between the coupling portions which greatly influences the antenna characteristic, and may influence the antenna characteristic. However, as in the above embodiment, respectively forming the coupling portions of two conductors on the two surfaces of a dielectric substrate will keep the inter-conductor distance between the coupling portions of the two conductors at the thickness of the dielectric substrate. Therefore, this can reduce factors that degrade the antenna characteristic as compared with an antenna without any dielectric substrate.

In addition, a dielectric substrate has the effect of focusing an electromagnetic field. For this reason, when the coupling portions of two conductors are respectively formed on the two surfaces of a dielectric substrate, the electromagnetic field generated between the coupling portions of the two conductors becomes larger than that when no dielectric substrate is used. Focusing an electromagnetic field at the coupling portions of the two conductors can increase the strength of the coupling generated between the two conductors serving as the coupling portions in the structure according to the above embodiment as compared with a structure without any dielectric substrate. This structure can increase the strength of coupling without increasing the line width of each conductor, and hence can further downsize the antenna as compared with a structure without any dielectric substrate.

In addition, the antenna formed on the dielectric substrate described above can be easily manufactured by ensuring an antenna region by removing conductors from the respective layers of a wireless communication module substrate, and printing the above antenna in the antenna region. This facilitates the manufacture of the antenna. It is therefore possible to manufacture the antenna at a lower cost than an antenna formed by, for example, folding a metal plate. In addition, since the thickness of an antenna formed on a dielectric substrate becomes equal to the thickness of the dielectric substrate, the antenna need not have a thickness larger than that of the dielectric substrate. The user may be caught on a protruding portion, if any, on the antenna. However, using the above arrangement can form an antenna without making a dielectric substrate forming, for example, a wireless communication module substrate have a thickness larger than that of the dielectric substrate. It is therefore possible to obtain an arrangement with less protruding portions of the antenna.

In addition, the above embodiment has exemplified the case in which the two conductors having the coupling portions are formed on the two surfaces of the dielectric substrate. If, however, a dielectric substrate has a multilayer structure, an antenna can also be implemented by forming two conductors having coupling portions on different layers. That is, the two conductors need not always be formed on the two surfaces of the dielectric substrate as long as the coupling portions of the two conductors face each other, and hence may be formed on different layers which allow the conductors to face each other. In this case, increasing the number of conductors of an antenna can obtain a multiband antenna which operates in many operating frequency bands. It is possible to obtain effects similar to the above effects by forming the coupling portions of the respective conductors on different layers of a dielectric substrate having a multilayer structure and coupling the coupling portions to each other, as needed. Furthermore, in the above embodiment, the two conductors having the coupling portions have the same line width. However, they may have different line widths.

In addition, in the above embodiment, the two conductors having the coupling portions overlap each other when viewed from a direction perpendicular to the surface of the substrate. However, any arrangement may be used as long as coupling occurs without making the conductor overlap each other.

In addition, according to the arrangement of the antenna of the above embodiment, the surface of the antenna ground does not overlap the conductors of the antenna when viewed from a direction perpendicular to the surface of the dielectric substrate. If, however, the surface of the antenna ground overlaps the conductors of the antenna, emitted electromagnetic waves are blocked by the surface of the antenna ground and are considerably weakened in a direction from the conductors of the antenna to the surface of the antenna ground. If a wireless communication function is mounted in an electronic device, the place where an opposing device which communicates with the electronic device exists may vary. In contrast to this, an antenna structure in which the surface of an antenna ground does not overlap the conductors of an antenna allows the antenna to emit electromagnetic waves evenly in all directions as compared with the antenna structure in which the surface of the antenna ground overlaps the conductors of the antenna.

Other Embodiments

Each embodiment described above has exemplified the wireless LAN antenna complying with the IEEE802.11 series standard. However, the present invention can be applied to antennas for wireless communication other than wireless LAN antennas complying with the IEEE802.11 series standard.

According to the present invention, it is possible to easily downsize an antenna while ensuring high antenna performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-170820, filed Aug. 20, 2013, and Japanese Patent Application No. 2014-156277, filed Jul. 31, 2014 which are hereby incorporated by reference herein in their entirety.

What is claimed is:

1. An antenna comprising:

a feeding point;

a first conductor which is connected to said feeding point, includes, as an open end, an end which is not connected to said feeding point, and has a linear shape; and a second conductor which is formed to branch from said first conductor, includes, as an open end, an end on an opposite side of a point branching from said first conductor, and has a linear shape, wherein at least part of said first conductor and at least part of said second conductor are formed on different planes, include coupling portions electromagnetically coupled to each other, and overlap with each other at least in part when viewed from a direction perpendicular to the planes, wherein the antenna comprises a dual band antenna, a length of said first conductor is smaller than ¼ of a wavelength in an operating frequency band to which said first conductor contributes, and a length of said second conductor is smaller than ¼ of a wavelength in an operating frequency band to which said second conductor contributes.

2. The antenna according to claim 1, wherein the coupling portions are portions where a distance between said first conductor and said second conductor falls within a predetermined distance.

3. The antenna according to claim 1, wherein at the coupling portions, an angle defined by a direction from the feeding point of said first conductor to the open end and a direction from the branching point of said second conductor to the open end is less than 90°.

4. The antenna according to claim 1, wherein at the coupling portions, an angle defined by a direction from the feeding point of said first conductor to the open end of said first conductor and a direction from the branching point of said second conductor to the open end of said second conductor is larger than 90°.

5. The antenna according to claim 1, wherein the coupling portion of said first conductor has a conductor width larger than that of other portions of said first conductor.

6. The antenna according to claim 1, wherein the coupling portion of said second conductor has a conductor width larger than that of other portions of said second conductor.

7. The antenna according to claim 1, wherein the coupling portion includes at least one of the open end of said first conductor or the open end of said second conductor.

8. The antenna according to claim 1, wherein at least one of said first conductor or at least part of said second conductor has a meander line shape.

9. The antenna according to claim 1, wherein at the coupling portions, a plane on which said first conductor is formed is a front surface of a substrate on which the antenna is formed, and a plane on which said second conductor is formed is a back surface of the substrate.

10. The antenna according to claim 1, wherein at the coupling portions, a plane on which said first conductor is formed is a plane between a first layer and a second layer of a multilayer substrate on which the antenna is formed, and a plane on which said second conductor is formed is a plane between the second layer and a third layer of the substrate.

11. The antenna according to claim 9, wherein the substrate comprises a dielectric substrate.

12. The antenna according to claim 1, wherein the antenna operates as a single band antenna, with a length of said first conductor or said second conductor which operates as the single band antenna being smaller than ¼ of a wavelength in an operating frequency band of the antenna.

* * * * *